US012667201B2

(12) United States Patent
Smith et al.

(10) Patent No.: US 12,667,201 B2
(45) Date of Patent: Jun. 30, 2026

(54) ADJUSTABLE BED BASE WITH DECLINE FEATURE ON BOTH ENDS

(71) Applicant: L&P Property Management Company, Carthage, MO (US)

(72) Inventors: Dustin W. Smith, Carthage, MO (US); Isaac T. Freelend, Sarcoxie, MO (US)

(73) Assignee: L&P Property Management Company, Carthage, MO (US)

( * ) Notice: Subject to any disclaimer, the term of this patent is extended or adjusted under 35 U.S.C. 154(b) by 0 days.

(21) Appl. No.: 19/051,672

(22) Filed: Feb. 12, 2025

(65) Prior Publication Data

US 2025/0213047 A1 Jul. 3, 2025

Related U.S. Application Data

(63) Continuation-in-part of application No. 18/166,076, filed on Feb. 8, 2023, now Pat. No. 12,329,284.

(60) Provisional application No. 63/721,626, filed on Nov. 18, 2024.

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 20/08
USPC ..... 5/618, 412
See application file for complete search history.

(56) References Cited

U.S. PATENT DOCUMENTS

| | | | | | |
|---|---|---|---|---|---|
| RE24,762 | E * | 1/1960 | Sellner | A47C 20/08 | 297/320 |
| 3,349,877 | A * | 10/1967 | Downs | A61G 7/015 | 477/8 |
| 3,636,573 | A * | 1/1972 | Bartz | A61G 7/015 | 5/660 |
| 4,685,159 | A | 8/1987 | Oetiker | | |
| 6,101,647 | A * | 8/2000 | Stroud | A47C 20/041 | 5/915 |
| 6,276,011 | B1 * | 8/2001 | Antinori | A47C 20/041 | 5/613 |
| 6,499,162 | B1 * | 12/2002 | Lu | A47C 20/08 | 5/616 |
| 10,111,530 | B1 | 10/2018 | Kramer et al. | | |
| 2003/0093863 | A1 * | 5/2003 | Grove | A61G 7/053 | 5/618 |
| 2004/0064891 | A1 * | 4/2004 | Horitani | A47C 20/08 | 5/618 |
| 2012/0240337 | A1 * | 9/2012 | Shih | A61G 7/015 | 5/616 |
| 2018/0028385 | A1 | 2/2018 | Sherman et al. | | |
| 2018/0110665 | A1 * | 4/2018 | Totemeier | A47C 20/08 | |
| 2020/0154888 | A1 * | 5/2020 | Brown | A47C 20/041 | |
| 2020/0154899 | A1 * | 5/2020 | Brown | A47C 20/12 | |

(Continued)

*Primary Examiner* — Justin C Mikowski
*Assistant Examiner* — Luke Hall
(74) *Attorney, Agent, or Firm* — Wood Herron & Evans LLP

(57) ABSTRACT

An adjustable bed base has a stationary frame and a stationary seat platform raised above the stationary frame via a riser. An articulating platform includes multiple platforms hinged together. Two platforms are hinged to the stationary seat platform. Front and rear linear actuators articulate the deck such that head and foot platforms decline relative to the stationary seat platform when the linear actuators are retracted. The head and foot platforms are inclined when the linear actuators are extended.

20 Claims, 27 Drawing Sheets

(56) References Cited

U.S. PATENT DOCUMENTS

| | | | | |
|---|---|---|---|---|
| 2020/0187662 | A1* | 6/2020 | Zeng | A47C 19/122 |
| 2020/0214460 | A1* | 7/2020 | Wang | A47C 21/006 |
| 2020/0214463 | A1* | 7/2020 | Xie | A47C 20/041 |
| 2021/0052085 | A1* | 2/2021 | Wang | A47C 31/005 |
| 2021/0259432 | A1* | 8/2021 | Wang | A47C 20/12 |
| 2022/0061542 | A1* | 3/2022 | Bishop | A47C 20/041 |
| 2022/0160140 | A1* | 5/2022 | Shih | A47C 20/041 |
| 2022/0369822 | A1* | 11/2022 | Ma | A47C 19/122 |
| 2023/0000257 | A1* | 1/2023 | Che | A47C 20/041 |
| 2023/0021490 | A1* | 1/2023 | Jian | A47C 20/041 |
| 2023/0033335 | A1* | 2/2023 | Wang | A47C 19/005 |
| 2023/0200546 | A1* | 6/2023 | Shih | A47C 20/041 5/174 |
| 2023/0200549 | A1* | 6/2023 | Shih | A47C 20/041 5/616 |
| 2023/0200550 | A1* | 6/2023 | Wang | A47C 20/041 5/618 |
| 2023/0309702 | A1* | 10/2023 | Freelend | A47C 20/041 5/618 |

* cited by examiner

ADJUSTABLE BED BASE WITH DECLINE FEATURE ON BOTH ENDS

CROSS REFERENCE TO RELATED APPLICATIONS

This application claims the benefit of U.S. provisional patent application No. 63/721,626 filed Nov. 18, 2024, which is fully incorporated by reference herein. This application claims priority to U.S. patent application Ser. No. 18/166,076 filed Feb. 8, 2023, which is fully incorporated by reference herein.

FIELD OF THE INVENTION

This invention relates generally to bedding products and, more particularly, to a motorized adjustable bed base.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together. One of the deck members, commonly a seat deck member, is commonly fixedly secured to the stationary frame. A head deck member is typically hinged to the seat deck member. A first motorized linear actuator inclines the front end of the head deck member so a user may sit up and read or watch television in an inclined position.

A leg deck member is commonly hinged to the stationary seat deck member and a foot deck member hinged to the leg deck member. A second motorized linear actuator serves to incline the leg and foot deck members around a person's knees for comfort.

One drawback to such common adjustable bed bases is that the head deck member articulated deck is either horizontal (when the deck members are aligned) or inclined. There is no mechanism to decline the head deck member. Similarly, the thigh deck member is either horizontal (when the deck members are aligned) or inclined. There is no mechanism to decline the thigh deck member.

Persons who sleep on their stomach may desire a curved sleeping surface such that the head and foot ends of the sleeping surface are below the middle portion of the sleeping surface. Other health conditions or situations may require that a person's head and/or feet is below his/her midsection.

In view of the above, there is a need for an adjustable bed base having head and foot platform sections which may be declined as well as inclined relative to a stationary middle platform second. There is further a need for an adjustable bed base which is capable of declining opposite ends of the articulated platform of the adjustable bed base when desired.

It is therefore an objective of this invention to provide an adjustable bed base having head and foot platform section which may be declined relative to a raised middle platform section.

It is further an objective of this invention to provide an adjustable bed base having an articulated platform comprising three pieces, a stationary middle piece being raised relative to a frame.

SUMMARY OF THE INVENTION

According to one aspect of the invention, an adjustable bed base comprises a generally rectangular stationary frame having opposed side rails, a head rail and a foot rail. The generally rectangular stationary frame includes a front cross rail extending between the opposed side rails and a rear cross rail extending between the opposed side rails. Legs which may or may not be adjustable in height are secured to the stationary frame for supporting the stationary frame.

The adjustable bed base further comprises a riser secured to the stationary frame. In one embodiment, the riser comprises two braces; each brace being secured to one of the side rails of the stationary frame. The braces extend parallel to the side rails of the stationary frame and are generally U-shaped with a flat upper portion.

The adjustable bed base further comprises an articulated platform comprising multiple platform sections hinged together, at least one platform section being secured to the riser such that the at least one platform section is stationary above the stationary frame. In one embodiment, the articulated platform comprises a head platform section, a seat platform section and a foot platform section hinged together. In some embodiments, at least one of the platform sections is a solid member made of either wood or plastic.

The adjustable bed base further comprises a front pusher assembly for moving a head platform section. The front pusher assembly comprises a front strengthener attached to one of the platform sections. The front pusher assembly further comprises a front linear actuator having a first end pivotally secured to a mounting bracket secured to the front cross rail and a second end pivotally secured to a mounting bracket secured to the front strengthener.

The adjustable bed base further comprises a rear pusher assembly for moving a foot platform section. The rear pusher assembly comprises a rear strengthener attached to one of the platform sections. The rear pusher assembly further comprises a rear linear actuator having a first end pivotally secured to a mounting bracket secured to the rear cross rail and a second end pivotally secured to a mounting bracket secured to the rear strengthener.

The linear actuators are preferably motorized. The articulated deck is generally U-shaped with the head and foot platform sections being declined when the front and rear linear actuators are retracted. A front edge of the head platform section is below a rear edge of the head platform section when the front linear actuator is retracted and a rear edge of the foot platform section is below a front edge of the foot platform section when the rear linear actuator is retracted. The maximum decline or tilt occurs when the linear actuator is fully retracted.

On the other hand, the articulated deck is generally U-shaped with the head and foot platform sections being inclined when the front and rear linear actuators are extended. The maximum incline or tilt occurs when the linear actuator is fully extended. A front edge of the head platform section is above a rear edge of the head platform section when the front linear actuator is extended and a front edge of the foot platform section is below a rear edge of the foot platform section when the rear linear actuator is extended.

Worded another way, the adjustable bed base comprises a stationary frame having opposed side rails, a head rail, a front cross rail, a rear cross rail and a foot rail. Legs, which may or may not be adjustable in height, support the stationary frame. The adjustable bed base further comprises a riser secured to the stationary frame.

The adjustable bed base further comprises an articulated platform comprising a stationary seat platform section secured to the riser, a head platform section hinged to one side of the stationary seat platform section and a foot platform section hinged to the other side of the stationary seat platform section. In some embodiments, at least one of the platform sections is a solid member made of either wood or plastic.

The adjustable bed base further comprises a front pusher assembly for inclining and declining the head platform section. The front pusher assembly comprises a front strengthener attached to the head platform section. The front pusher assembly further comprises a front linear actuator having a first end pivotally secured to a mounting bracket secured to the front cross rail and a second end pivotally secured to the front strengthener.

The adjustable bed base further comprises a rear pusher assembly for inclining and declining the foot platform section. The rear pusher assembly comprises a rear strengthener attached to the foot platform section. The rear pusher assembly further comprises a rear linear actuator having a first end pivotally secured to a mounting bracket secured to the rear cross rail and a second end pivotally secured to the rear strengthener.

The head and foot platform sections are declined when the front and rear linear actuators are retracted and inclined when the front and rear actuators are extended.

Worded a third way, the adjustable bed base comprises a stationary frame having opposed side rails, a head rail and a foot rail. Legs, which may or may not be adjustable in height, support the stationary frame.

The adjustable bed base further comprises a riser secured to the side rails of the stationary frame. The adjustable bed base further comprises a stationary seat platform section secured to the riser, a head platform section hinged to one side of the stationary seat platform section and a foot platform section hinged to the other side of the stationary seat platform section. In one embodiment, each of the platform sections is a solid member made of either wood or plastic.

The adjustable bed base further comprises a front pusher assembly for moving the head platform section. The front pusher assembly comprises a front strengthener attached to the head platform section. The front pusher assembly further comprises a front linear actuator having a first end pivotally secured to a mounting bracket secured to a first cross rail and a second end pivotally secured to a mounting bracket secured to the front strengthener.

The adjustable bed base further comprises a rear pusher assembly for moving the foot platform section. The rear pusher assembly comprises a rear strengthener attached to the foot platform section. The rear pusher assembly further comprises a rear linear actuator having a first end pivotally secured to a second cross rail and a second end pivotally secured to a mounting bracket secured to the rear strengthener.

The head platform section is declined when the front linear actuator is retracted. Similarly, the foot platform section is declined when the rear linear actuator is retracted. The head and foot platform sections are horizontal and coplanar when in their home positions.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
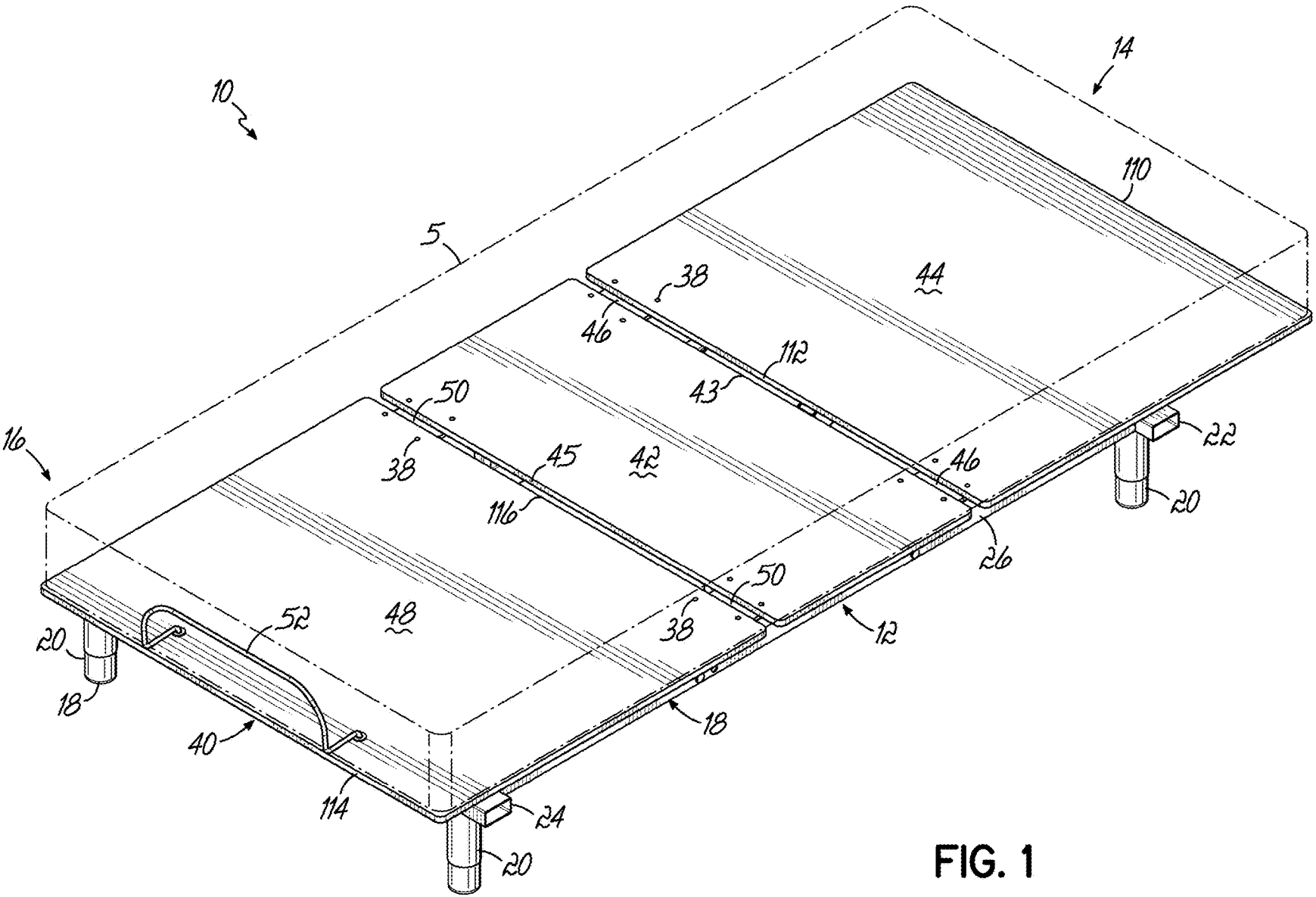
FIG. 1 is a top perspective view of an adjustable bed base.

Referring to FIG. 1, an adjustable bed 10 includes an adjustable bed base 12 for supporting a mattress 5. The adjustable bed base 12 has a head end 14 and a foot end 16. The adjustable bed base 12 of the present invention may be used with any type of mattress. The mattress is not intended to be limited by the drawings.

Figure 2:
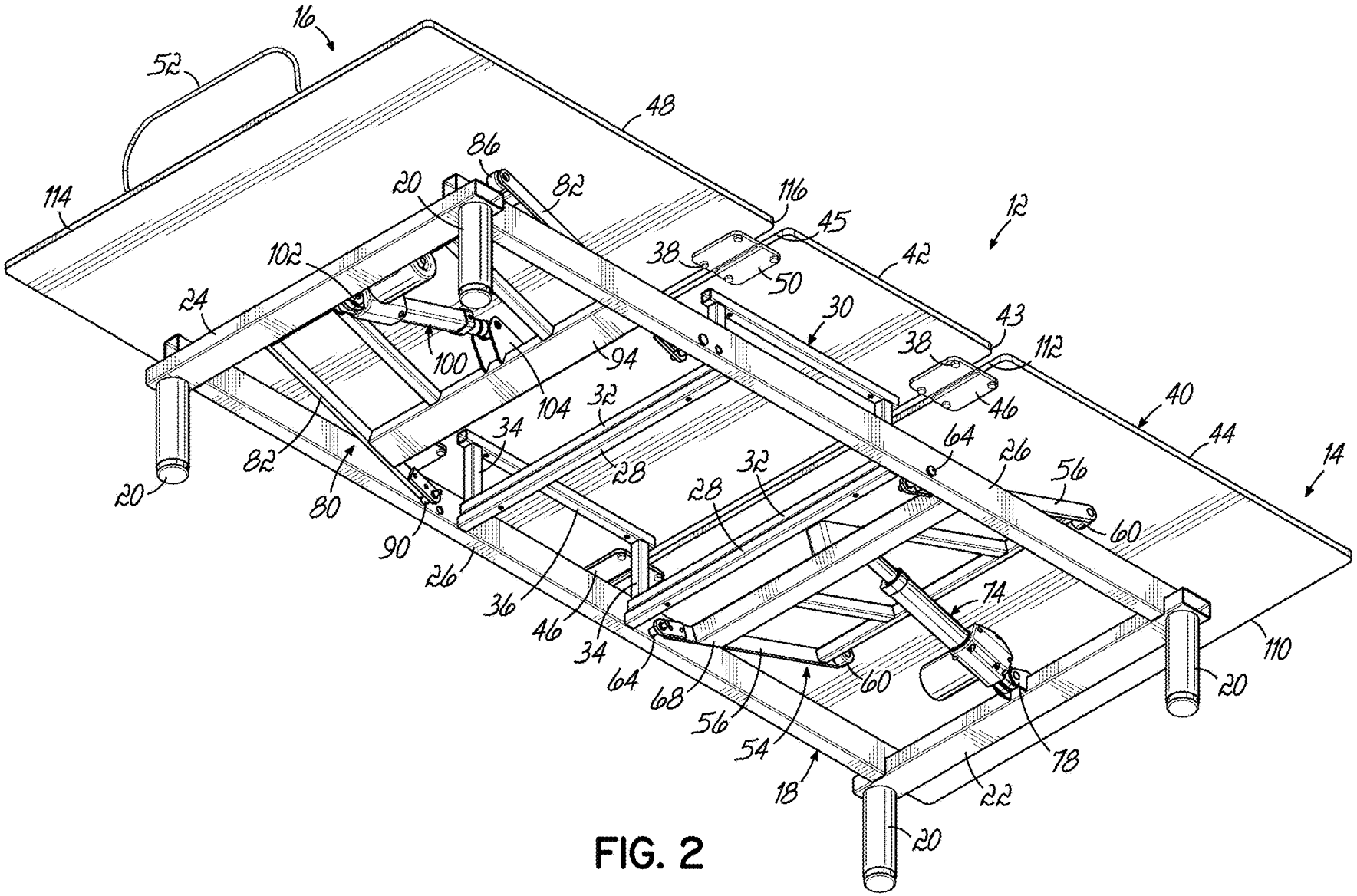
FIG. 2 is a bottom perspective view of the adjustable bed base of FIG. 1.

As best shown in FIG. 2, the adjustable bed base 12 comprises a generally rectangular stationary frame 18 supported by leg assemblies or legs 20. The leg assemblies 20 are illustrated as being adjustable in height. Although one type of leg assembly 20 is illustrated supporting the adjustable bed base 12, any other type of leg assembly including unitary legs not adjustable in height may be used in accordance with the present invention. The legs of the adjustable bed base are not intended to be limited by the drawings in any of the embodiments shown or described herein.

Figure 4:
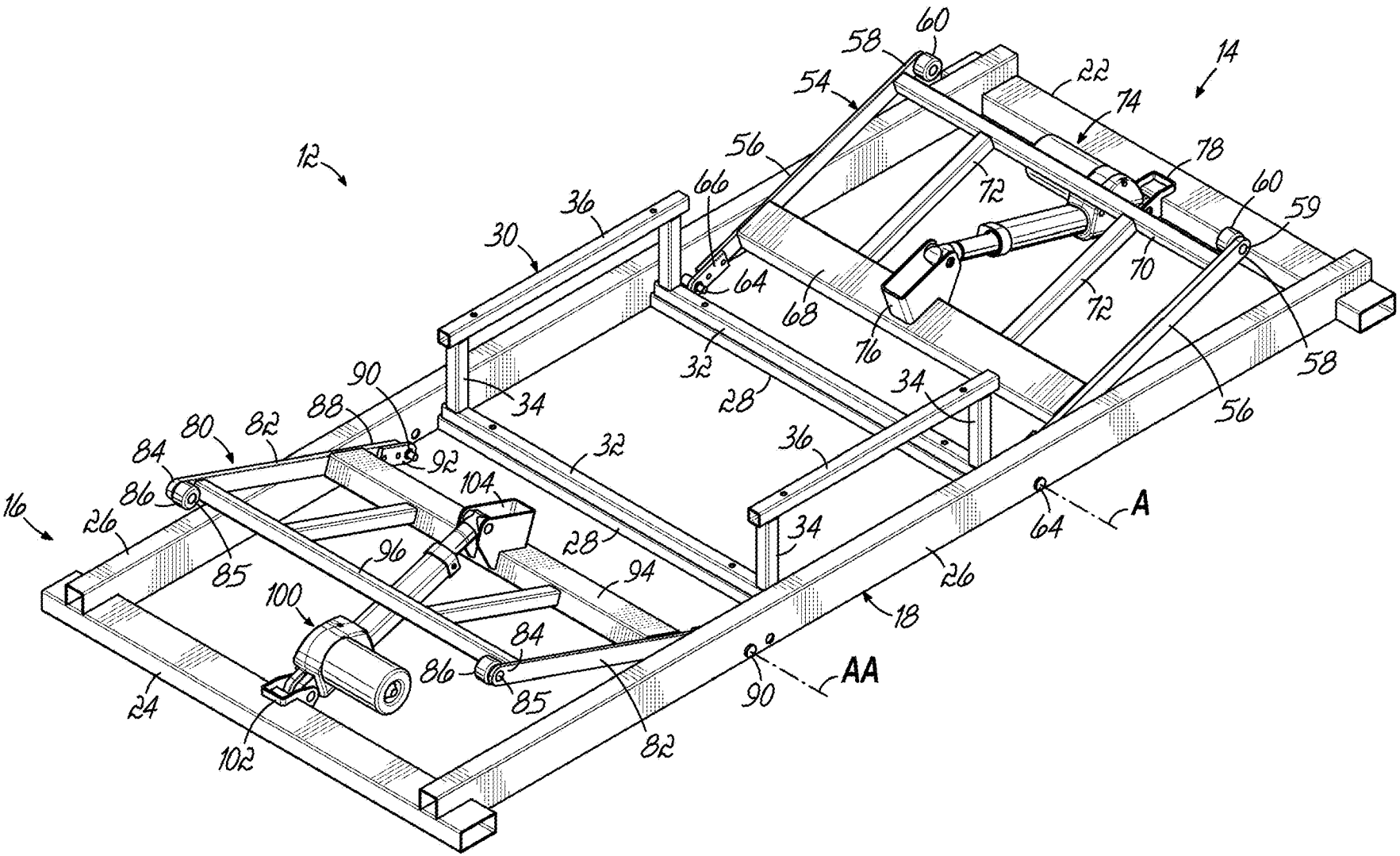
FIG. 4 is an enlarged perspective view of a portion of the adjustable bed base of FIG. 1.

As best shown in FIG. 4, the generally rectangular stationary frame 18 comprises a head rail 22, a foot rail 24 and two opposed side rails 26. The head rail 22 and foot rail 24 each extends between the opposed side rails 26. Although the drawings show the head, foot and side rails 22, 24 and 26, respectively, each having a hollow interior and being a certain size and/or shape, the drawings are not intended to be limiting in any of the embodiments shown or described herein.

The stationary frame 18 further comprises two cross rails 28 secured to the side rails 26 of the stationary frame 18, each cross rail 28 extending between the side rails 26 of the stationary frame 18. Although the drawings show each of the cross rails 28 having a hollow interior and being a certain size and/or shape, the drawings are not intended to be limiting. Although the stationary frame 18 is typically made of metal, it may be made of any known material.

As best shown in FIG. 4, the adjustable bed base 12 further comprises a riser 30 secured to the stationary frame 18. The riser 30 comprises two cross members 32 secured to the cross rails 28 of the stationary frame 18. The riser 30 further comprises stubs 34 extending upwardly from the cross members 32 of the riser 30. More specifically, two stubs 34 are secured to each of the cross members 32 at opposite ends of the cross member 32. As best shown in FIG. 4, the riser 30 further comprises two braces 36, each of the braces 36 extending between two stubs 34. Each of the braces 36 is linear and extends parallel to one of the side rails 26 of the stationary frame 18 and is spaced above the side rail 26 of the stationary frame 18.

As best shown in FIGS. 1 and 2, the adjustable bed base 12 further comprises an articulating platform 40 comprising a seat platform section 42 secured to the braces 36 of the riser 30 with fasteners 38 and does not move when the platform 40 is articulated. See FIGS. 5A-5E. A head platform section 44 is hinged to the seat platform section 42 with hinges 46. Lastly, a foot platform section 48 is hinged to the seat platform section 42 with hinges 50. Although the platform sections 42, 44 and 48 are shown being solid pieces, one or more of them may have openings therethrough. The drawings are not intended to be limiting. Similarly, although the head and foot platform sections 44, 48 are illustrated being approximately the same size, the size of any of the platform sections is not intended to be limited by the drawings.

Although two hinges are shown securing adjacent platform sections, any other number of hinges may be used. The seat platform section 42 has a front edge 43 closest to the head platform section 44 and a rear edge 45 closest to the foot platform section 48.

As best shown in FIG. 1, a stop 52 is secured to the foot platform section 48 of the articulating platform 40 and functions to prevent movement of the mattress 5 relative to the adjustable bed base 12 when the articulating platform 40 is articulated.

Figure 3:
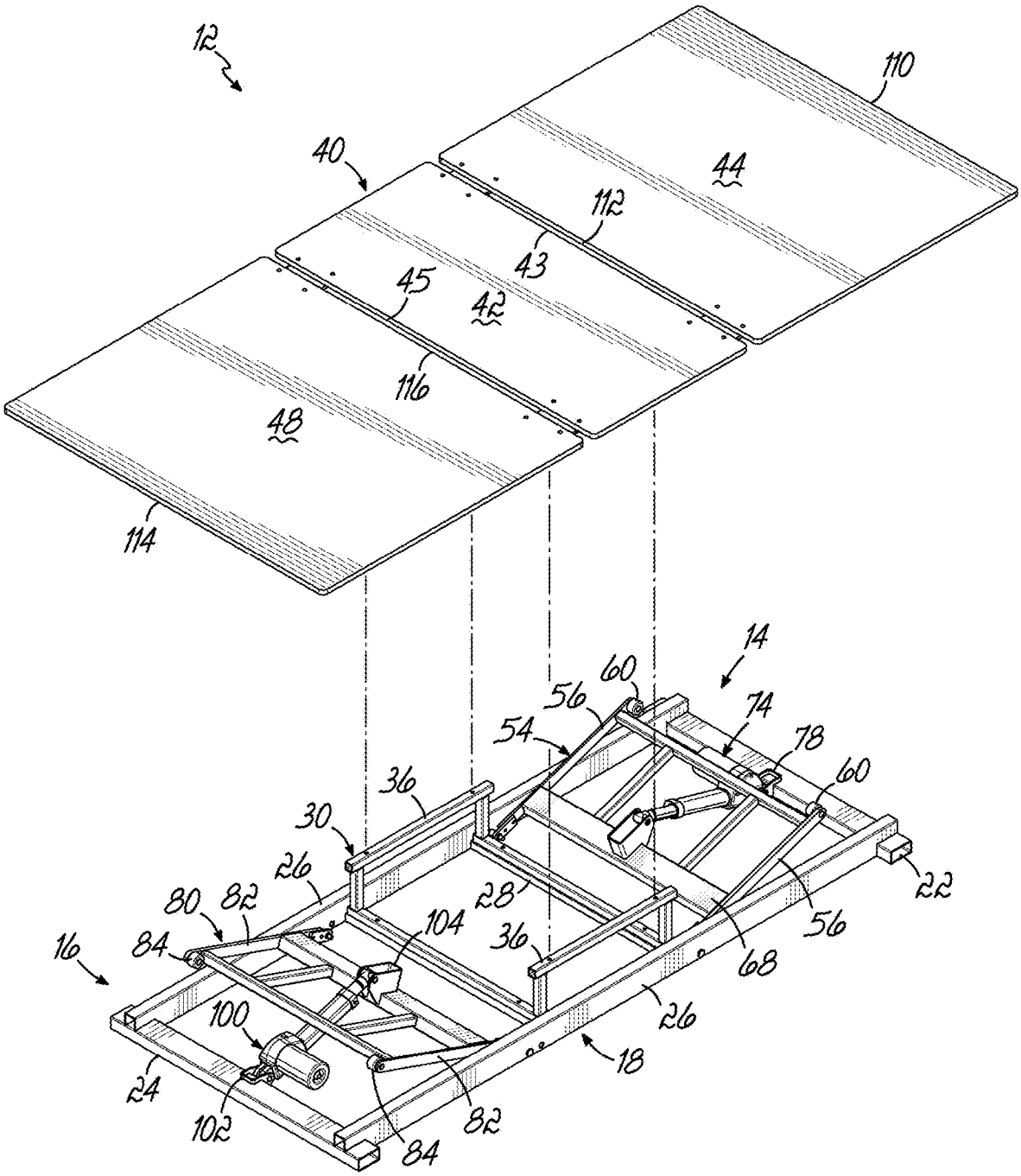
FIG. 3 is perspective view of the adjustable bed base of FIG. 1 showing the articulated platform separated from the remainder of the adjustable bed base.

As best shown in FIGS. 3 and 4, the adjustable bed base 12 further comprises a front pusher assembly 54 for moving the head platform section 44. The front pusher assembly 54 comprises two arms 56. Each of the arms 56 has a first end 58 to which a rotatable wheel 60 is secured with a pin 59. Each of the arms 56 has a second end 62 which is pivotally secured to one of the side rails 26 of the stationary frame 18 with a pin 64 such that the arm pivots about an axis A, as shown in FIG. 4. Each arm 56 may include an arm extension 66 best shown in FIG. 4 or be a unitary member.

As best shown in FIG. 4, the front pusher assembly 54 of the adjustable bed base 12 further comprises a lower stabilizer 68 extending between the arms 56 and an upper stabilizer 70 extending between the arms 56. The upper stabilizer 70 is closer to the wheels 60 than the lower stabilizer 68. The upper and lower stabilizers 70, 68 are each shown as a hollow member but either may be a solid or partially solid member. Two braces 72 extend between the upper and lower stabilizers 70, 68. The braces 72 extend parallel to the arms 56.

As best shown in FIG. 4, the front pusher assembly 54 of the adjustable bed base 12 further comprises a motorized front linear actuator 74 for moving (inclining or declining) the head platform section 44. The motorized front linear actuator 74 has a rear or first end pivotally secured to a mounting bracket 76 secured to the lower stabilizer 68 of the front pusher assembly 54. In some embodiments, the mounting bracket 76 may be considered an integral part of the lower stabilizer 68. For example, two ears may be welded onto the lower stabilizer 68 with a pin extending therebetween. The motorized front linear actuator 74 has a front or second end pivotally secured to a mounting bracket 78 secured to the head rail 22 of the stationary frame 18. In some embodiments, the mounting bracket 78 may be considered an integral part of the head rail 22. For example, two ears may be welded onto the head rail 22 with a pin extending therebetween. Although the mounting brackets 76, 78 are shown having certain shapes, either mounting bracket may be any other desired shape. Again, the drawings are not intended to be limiting.

As best shown in FIGS. 3 and 4, the adjustable bed base 12 further comprises a rear pusher assembly 80 for moving (inclining or declining) the foot platform section 48. The rear pusher assembly 80 comprises two links 82. Each of the links 82 has a first end 84 to which a rotatable wheel 86 is secured with a pin 85. Each of the links 82 has a second end 88 which is pivotally secured to one of the side rails 26 of the stationary frame 18 with a pin 90 such that the arm pivots about an axis AA, as shown in FIG. 4. Each link 82 may include a link extension 92 best shown in FIG. 4 or be a unitary member.

As best shown in FIG. 4, the rear pusher assembly 80 of the adjustable bed base 12 further comprises a lower stabilizer 94 extending between the links 82 and an upper stabilizer 96 extending between the links 82. The upper stabilizer 96 is closer to the wheels 86 than the lower stabilizer 94. The upper and lower stabilizers 96, 94 are each shown as a hollow member but either may be a solid or partially solid member. Two braces 98 extend between the upper and lower stabilizers 96, 94. The braces 98 extend parallel to the links 82.

As best shown in FIG. 4, the rear pusher assembly 80 of the adjustable bed base 12 further comprises a motorized rear linear actuator 100 for inclining the foot platform section 48. The motorized rear linear actuator 100 has a rear or first end pivotally secured to a mounting bracket 102 secured to the rear rail 24 of the stationary frame 18. In some embodiments, the mounting bracket 102 may be considered an integral part of the rear rail 24. For example, two ears may be welded onto the rear rail 24 with a pin extending therebetween. The motorized rear linear actuator 100 has a front or second end pivotally secured to a mounting bracket 104 secured to the lower stabilizer 94 of the rear pusher assembly 80. In some embodiments, the mounting bracket 104 may be considered an integral part of the lower stabilizer 94. For example, two ears may be welded onto the lower stabilizer 94 with a pin extending therebetween. Although the mounting brackets 102, 104 are shown having certain shapes, either mounting bracket may be any other desired shape. Again, the drawings are not intended to be limiting.

Figure 5A:
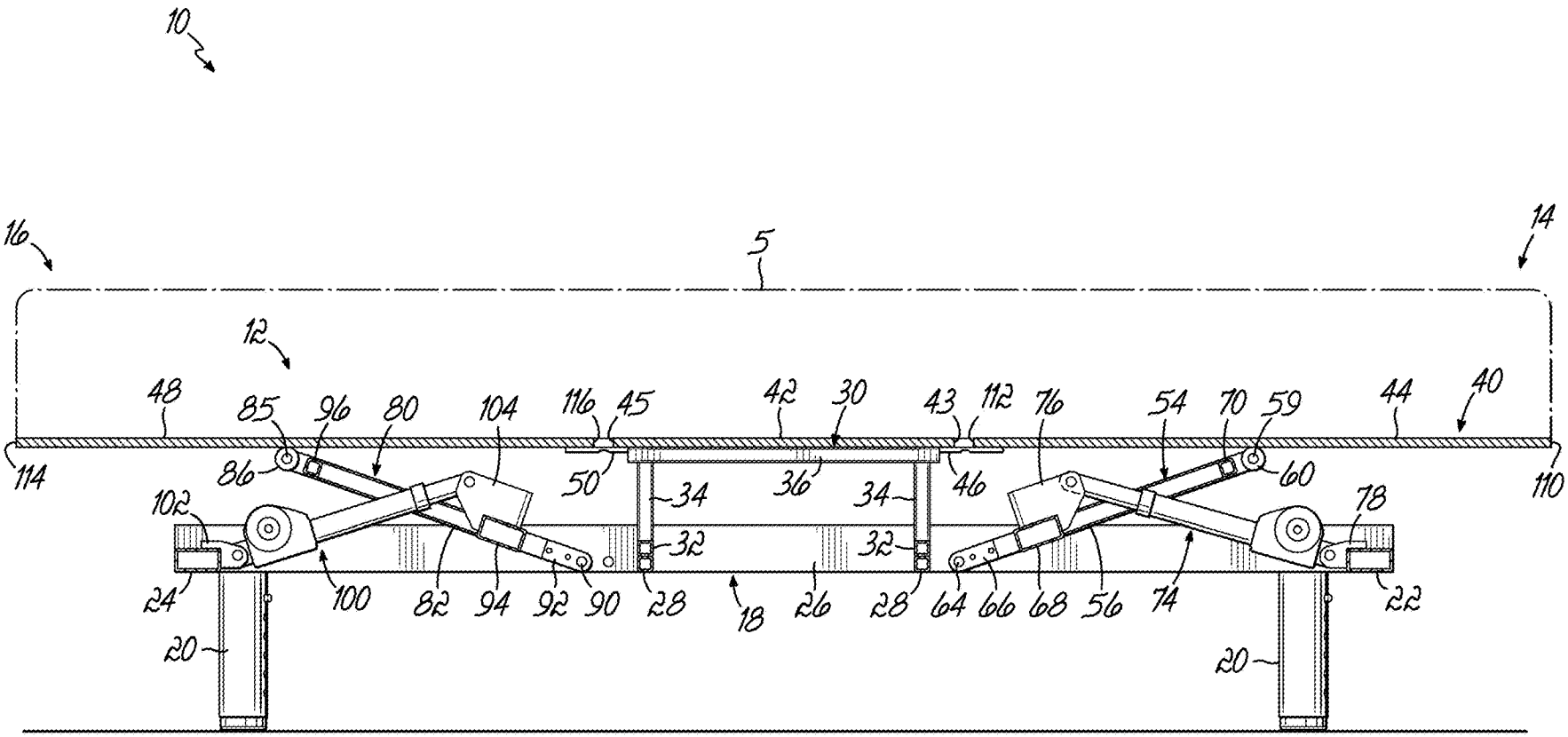
FIG. 5A is a side view, partially in cross-section, of the adjustable bed base of FIG. 1 in a home position.
Figure 5B:
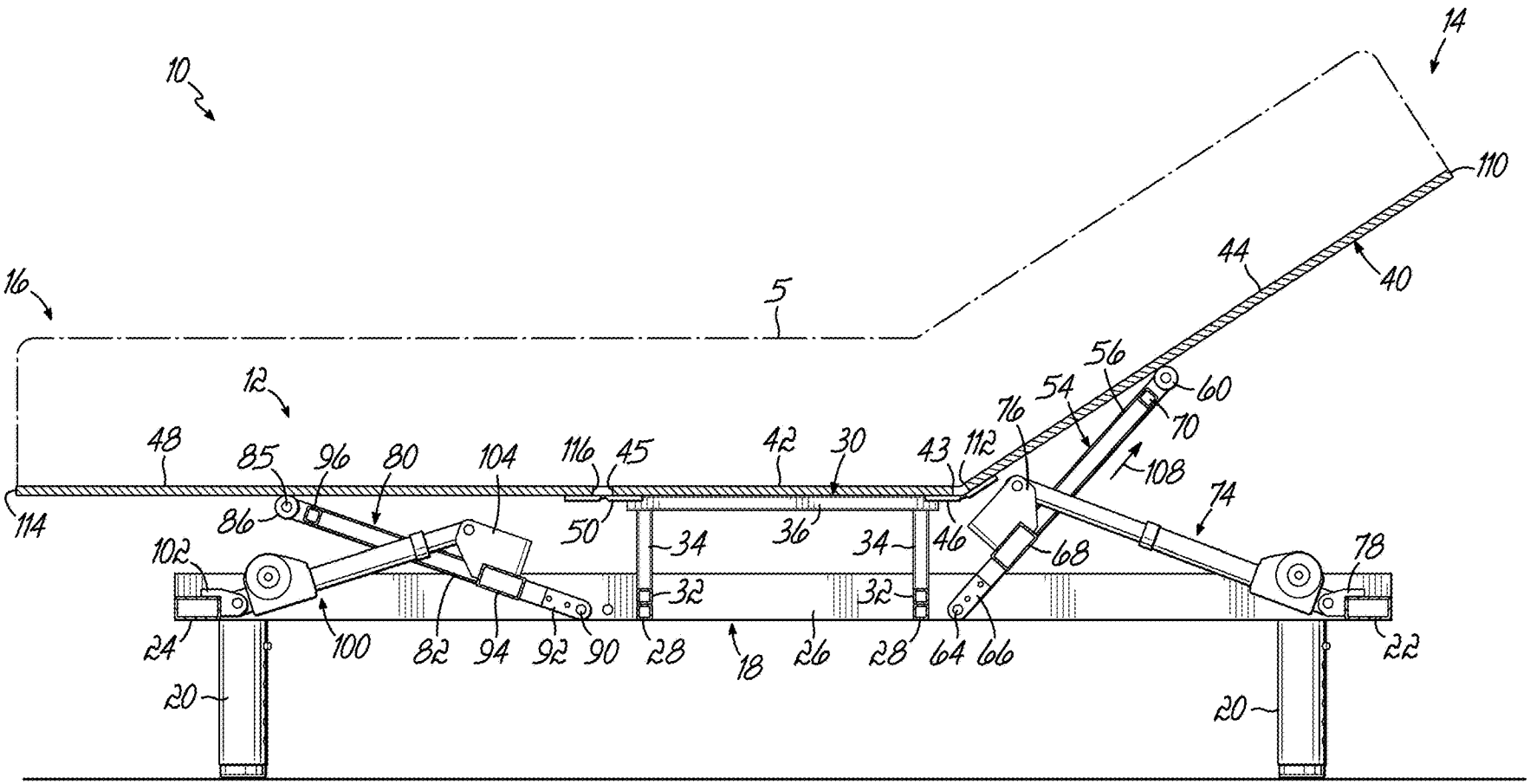
FIG. 5B is a side view, partially in cross-section, of the adjustable bed base of FIG. 1 showing the head platform section in an inclined position and the foot platform section in its home position.

FIGS. 5A-5E show different positions of the adjustable bed base 12, due to the positions of the motorized front and rear linear actuators 74, 100. FIG. 5A shows the articulating platform 40 being flat with the platform sections 42, 44 and 48 being co-planar. FIG. 5A shows the adjustable bed base 12 in a home position with the platform sections 42, 44 and 48 being in a horizontal position. In this home position, the motorized front and rear linear actuators 74, 100 are each partially retracted but not fully retracted. From this home position shown in FIG. 5A, the motorized front linear actuator 74 of adjustable bed base 12 is activated via remote control (not shown) or an app on a phone (not shown) to expand or lengthen. Such expansion of the motorized front linear actuator 74, shown by arrow 108 in FIG. 5B, inclines the head platform section 44 such that a front edge 110 of the front platform section 44 is above a rear edge 112 of the head platform section 44. This expansion of the motorized front linear actuator 74 pivots the front pusher assembly 54 about pivot axis A causing upward movement of the wheels 60 along the bottom surface of the head platform section 44 which raises the front edge 110 of the head platform section 44 and moves the head platform section 44 to its fully inclined position shown in FIG. 5B. This forward movement of the wheels 60 causes the head platform section 44 to rise upwardly, thereby to its fully inclined position shown in FIG. 5B. FIG. 5B shows the foot platform section 48 in a flat position and the head platform section 44 in its fully inclined position due to full extension of the motorized front linear actuator 74.

Figure 5C:
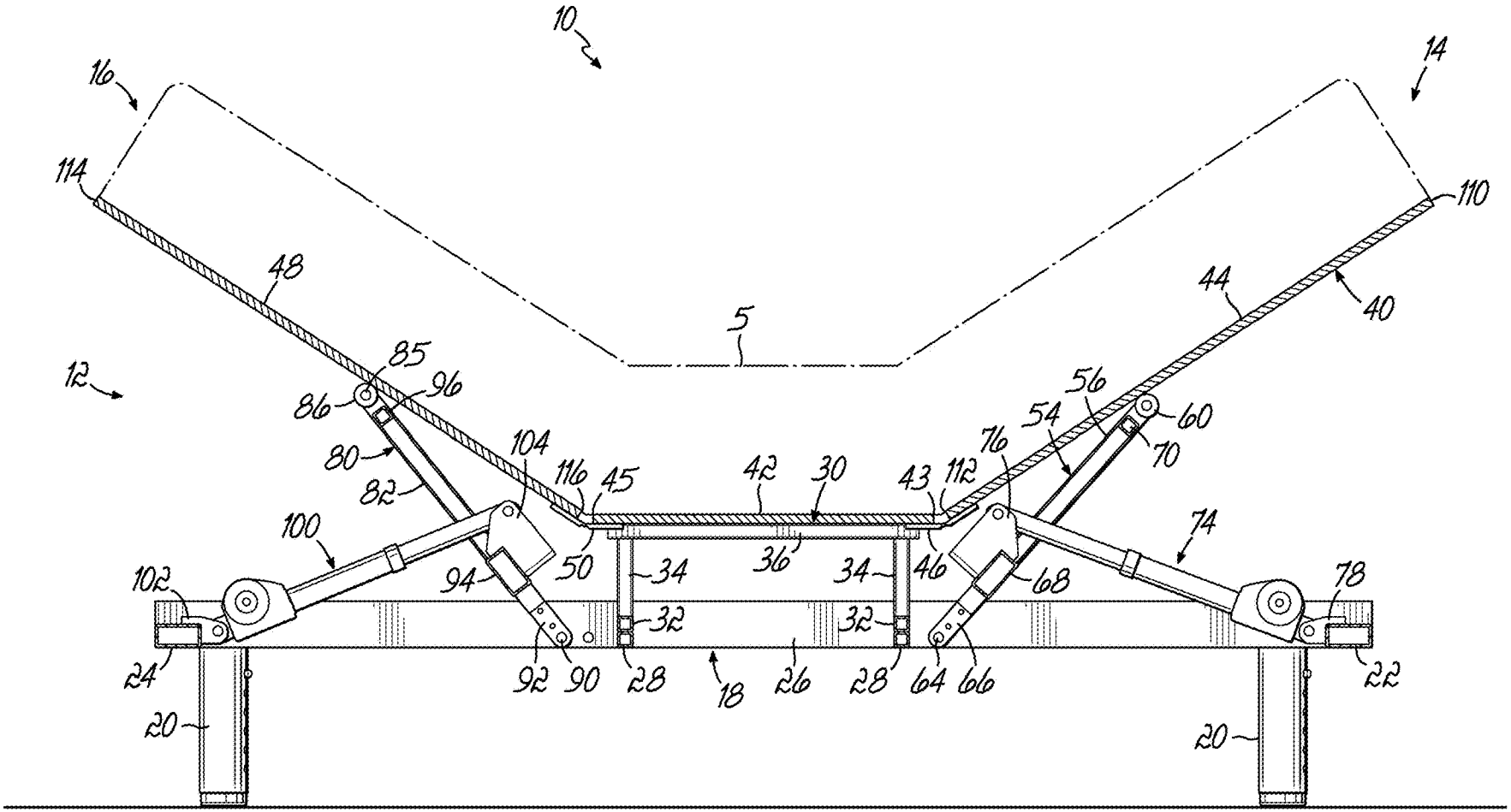
FIG. 5C is a side view, partially in cross-section, of the adjustable bed base of FIG. 1 showing the head and foot platform sections in their inclined positions.

FIG. 5C shows the adjustable bed base 12 in a position with the head platform section 44 in its fully inclined position like FIG. 5B. FIG. 5C also shows the foot platform section 48 in its fully inclined position due to full extension of the rear linear actuator 80. From its home position shown in FIG. 5B, the motorized rear linear actuator 80 of adjustable bed base 12 is activated via remote control (not shown) or phone app (not shown) to expand or lengthen. Such expansion of the motorized rear linear actuator 80, causes the rear pusher assembly 80 to pivot about axis AA to a fully inclined position. This pivotal movement of the rear pusher assembly 80 causes the wheels 86 of the rear pusher assembly 80 to move upwardly along the underside of the foot platform section 48, thereby raising a rear edge 114 of the foot platform section 48 above a front edge 116 of the foot platform section 48. When the adjustable bed base is in the position shown in FIG. 5C with both motorized linear actuators 74, 100 fully extended, the articulating platform 40 assumes a generally U-shape.

Figure 5D:
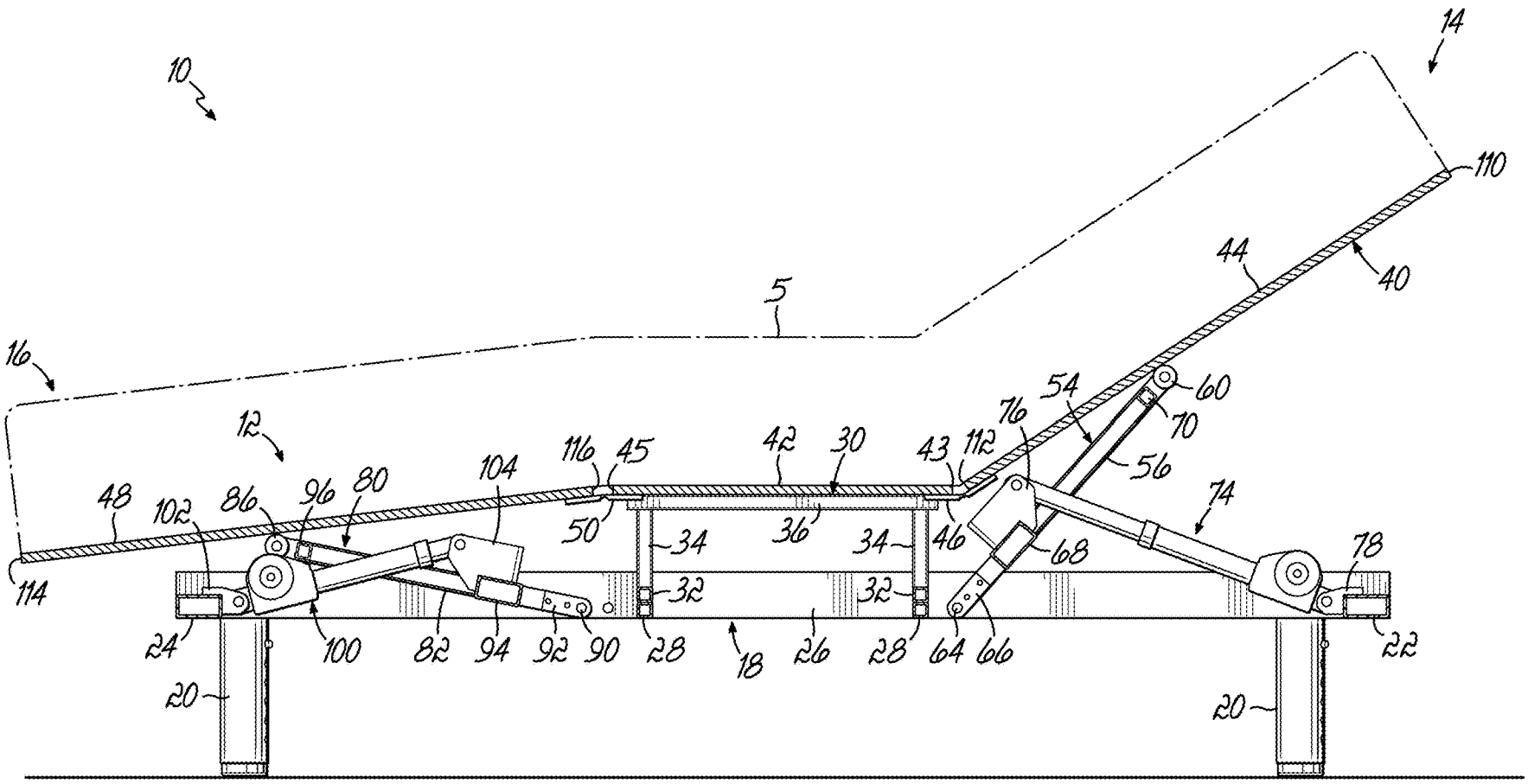
FIG. 5D is a side view, partially in cross-section, of the adjustable bed base of FIG. 1 showing the head platform section in an inclined position and the foot platform section in a declined position.

FIG. 5D shows the adjustable bed base 12 in a position with the head platform section 44 in its fully inclined position like FIG. 5C. FIG. 5D shows the foot platform section 48 in its fully declined position due to full retraction of the motorized rear linear actuator 100. From its home position shown in FIG. 5B, the rear linear actuator 80 of adjustable bed base 12 is activated via remote control (not shown) or phone app (not shown) to contract or shorten. Such contraction of the motorized rear linear actuator 80, causes the rear pusher assembly 80 to pivot about axis AA to a fully declined position. This pivotal movement of the rear pusher assembly 80 causes the wheels 86 of the rear pusher assembly 80 to move downwardly along the underside of the foot platform section 48, thereby lowering a rear edge 114 of the foot platform section 48 below a front edge 116 of the foot platform section 48.

Figure 5E:
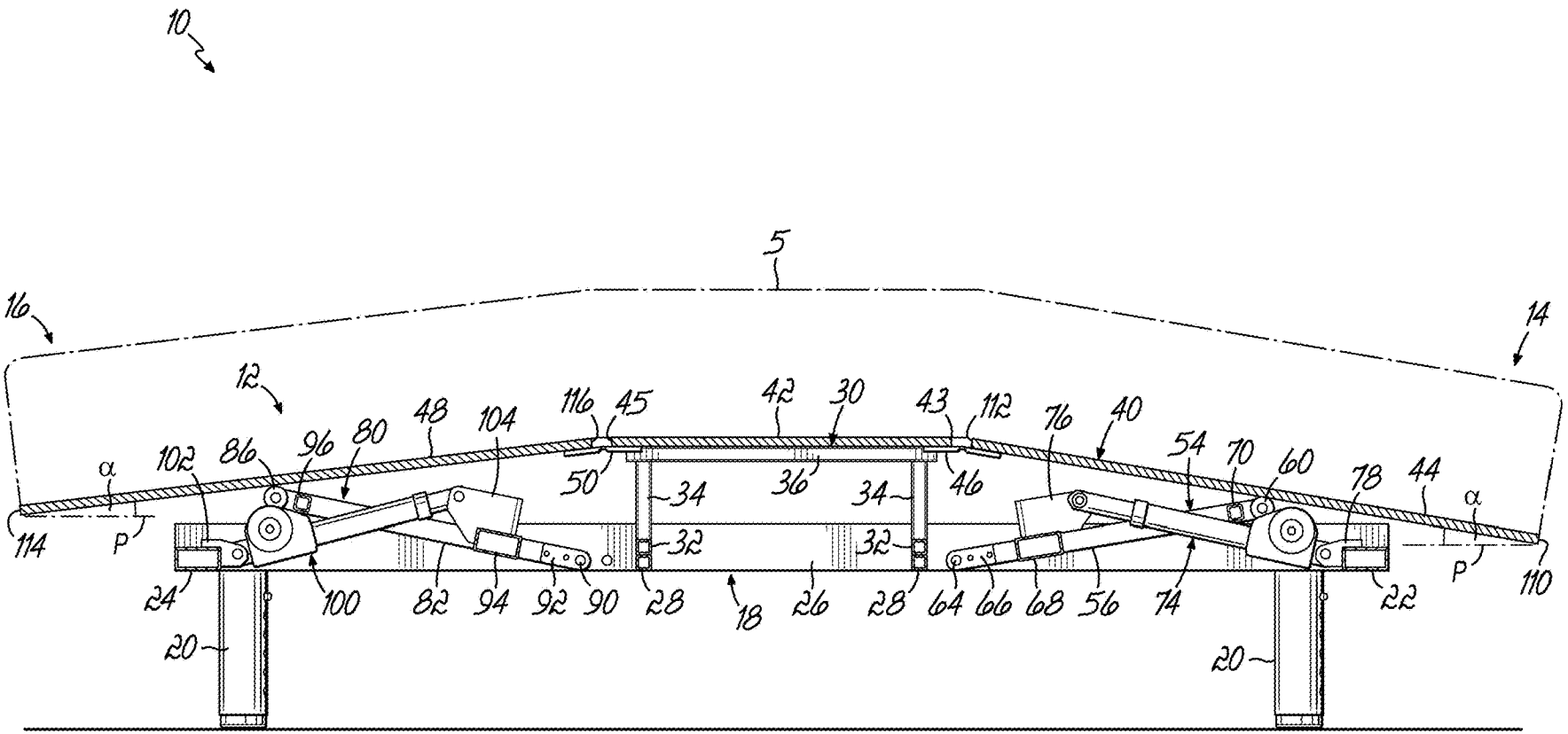
FIG. 5E is a side view, partially in cross-section, of the adjustable bed base of FIG. 1 showing the head platform section in a declined position and the foot platform section in a declined position.

FIG. 5E shows the adjustable bed base 12 in a position with the foot platform section 48 in its fully declined position like FIG. 5D. FIG. 5E shows the head platform section 44 in its fully declined position due to full retraction of the front linear actuator 80. From its home position shown in FIG. 5B, the front linear actuator 80 of adjustable bed base 12 is activated via remote control (not shown) or phone app (not shown) to contract or shorten. Such contraction of the front linear actuator 80, causes the front pusher assembly 54 to pivot about axis A to a fully declined position. This pivotal movement of the front pusher assembly 54 causes the wheels 60 of the front pusher assembly 54 to move downwardly, thereby lowering the front edge 110 of the head platform section 44 below the rear edge 112 of the head platform section 44.

When the adjustable bed base 12 is in this "down" position shown in FIG. 5E, the articulating platform 40 is in a generally inverted U-shaped configuration. In this inverted U-shaped configuration, the outer edges 110, 114 of the articulating platform 40 are generally co-planar in a plane P, the head and foot platform sections 44, 48 each being declined at an angle at an angle θ which may be up to six degrees relative to horizontal.

Figure 6:
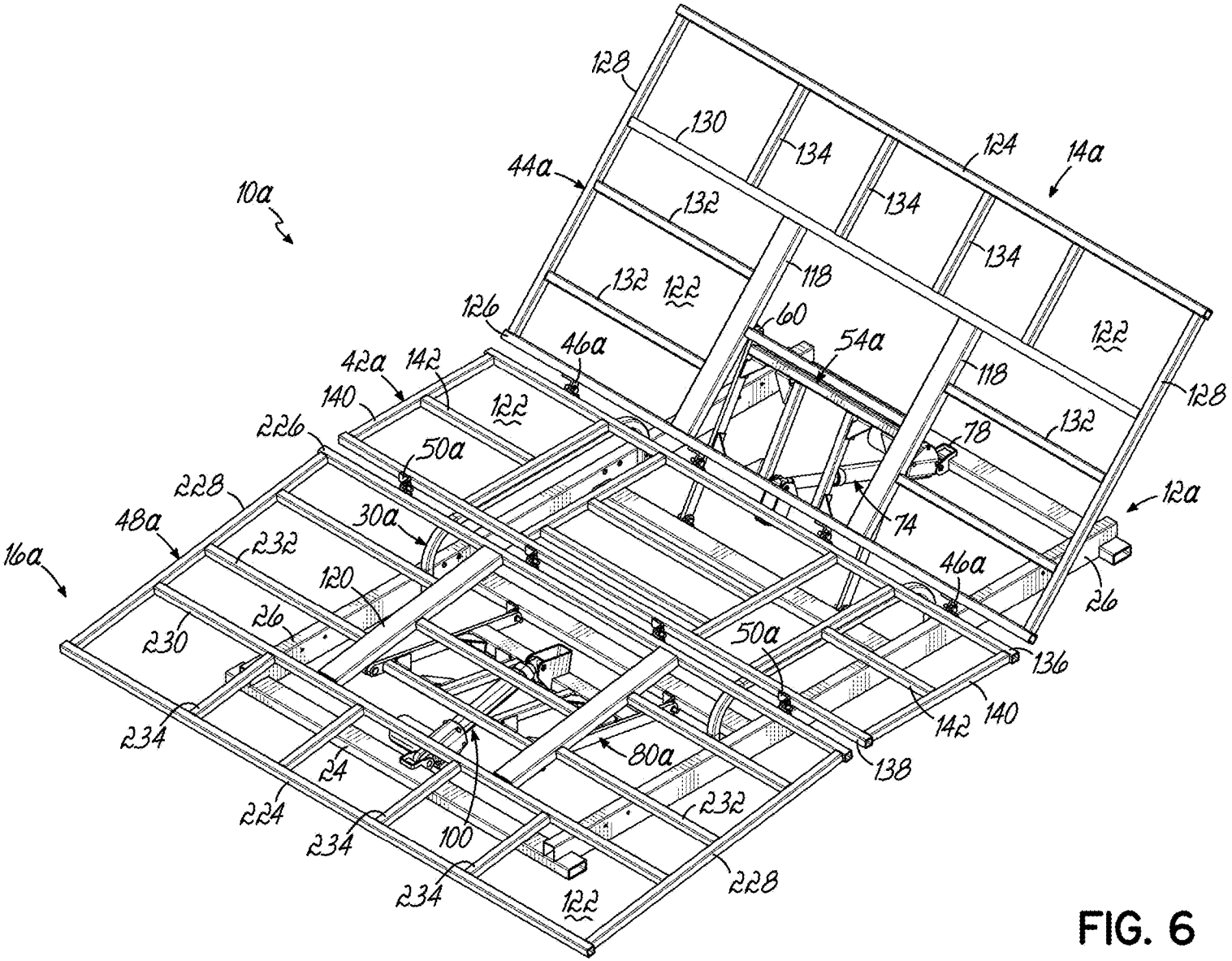
FIG. 6 is a top perspective view of an alternative embodiment of adjustable bed base.
Figure 7:
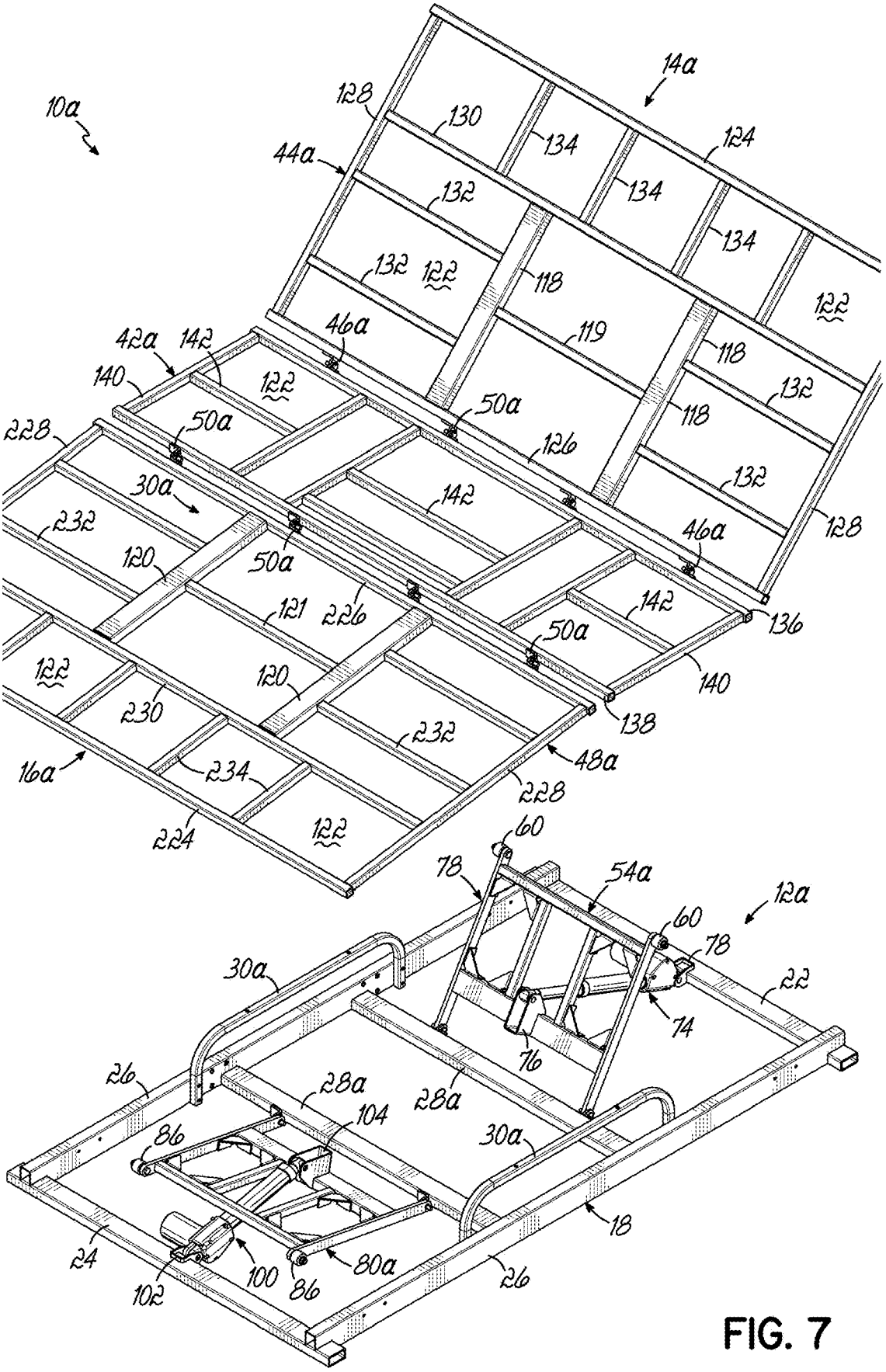
FIG. 7 is perspective view of the adjustable bed base of FIG. 6 showing the articulated platform separated from the remainder of the adjustable bed base.

FIGS. 6 and 7 illustrate a different embodiment of adjustable bed 10*a*. For simplicity, like parts have like numbers but with an "a" designation. The adjustable bed 10*a* comprises an adjustable bed base 12*a* for supporting a mattress 5. The adjustable bed base 12*a* has a head end 14*a* and a foot end 16*a*. The adjustable bed base 12*a* may be used with any type of mattress (not shown).

The adjustable bed base 12*a* has a stationary frame 12*a* similar to stationary frame 12 described above. One principal difference in the stationary frame 12*a* compared to the stationary frame 12 is that the cross rails 28*a* are larger than cross rails 28.

The adjustable bed base 12*a* has two risers 30*a*, each being an arcuate or curved member(s) secured to one of the side rails 26 of stationary frame 12*a*. Each riser 30*a* may be made of any number of pieces joined together in any known manner including welding.

The adjustable bed base 12*a* has a front pusher assembly 54*a* similar to the front pusher assembly 54 described above. The principal difference between the front pusher assembly 54*a* compared to the front pusher assembly 54 is that the wheels 60 of front pusher assembly 54*a* are outside, rather than inside of the arms 56. The motorized front linear actuator 74 and associated mounting brackets 78, 76 are the same.

The adjustable bed base 12*a* has a rear pusher assembly 80*a* similar to the rear pusher assembly 80 described above. The principal difference between the rear pusher assembly 80*a* compared to the rear pusher assembly 80 is that the wheels 86 of rear pusher assembly 80*a* are outside, rather than inside of the links 82. The motorized rear linear actuator 100 and associated mounting brackets 102, 104 are the same.

The adjustable bed base 12*a* further comprises an articulating platform 40*a* comprising a seat platform section 42*a* secured to the risers 30*a* and does not move when the platform 40*a* is articulated. See FIGS. 6. A head platform section 44*a* is hinged to the seat platform section 42*a* with hinges 46*a*. Lastly, a foot platform section 48*a* is hinged to the seat platform section 42*a* with hinges 50*a*. Although four hinges are shown securing adjacent platform sections, any other number of hinges may be used.

The head platform section 44*a* has two ramps 118 on which the wheels 60 of the front pusher assembly 54*a* ride to move the head platform section 44*a* relative to the stationary seat platform section 42*a*. Similarly, the foot platform section 48*a* has two ramps 120 on which the wheels 86 of the rear pusher assembly 80*a* ride to move the foot platform section 48*a* relative to the stationary seat platform section 42*a*.

The head platform section 44*a* is not a solid member but rather a plurality of metal segments or pieces welded or otherwise joined together with gaps 122 therebetween. The segments include outer perimeter segment 124, inner perimeter segment 126 and side perimeter segments 128 which together define the size of the head platform section 44*a*. The hinges 46*a* are secured to the inner perimeter segment 126 of the head platform section 44*a* and to the head perimeter segment 136 of the seat platform section 42*a* described below. The ramps 118 are parallel to the side perimeter segments 128 and extend between an intermediate segment 130 and the inner perimeter segment 126. A ramp segment 119 extends between the ramps 118. Additional segments 132 extend between one of the ramps 118 and one of the side perimeter segments 128. Secondary segments 134 extend between the outer perimeter segment 124 and the intermediate segment 130.

The seat platform section 42*a* is not a solid member but rather a plurality of metal segments or pieces welded or otherwise joined together with gaps 122 therebetween. The segments include a head perimeter segment 136, a foot perimeter segment 138 and side perimeter segments 140 which together define the size of the seat platform section 42*a*. The hinges 46*a* are secured to the head perimeter segment 136. The seat platform section 42*a* further comprises interior segments 142 arranged in one pattern but not intended to be limited to the pattern shown.

The foot platform section 48*a* is not a solid member but rather a plurality of metal segments or pieces welded or otherwise joined together with gaps 122 therebetween. The segments include outer perimeter segment 224, inner perimeter segment 226 and side perimeter segments 228 which together define the size of the foot platform section 48*a*. The hinges 50*a* are secured to the inner perimeter segment 226 of the foot platform section 48*a* and to the foot perimeter segment 138 of the seat platform section 42*a* described above. The ramps 120 are parallel to the side perimeter segments 228 and extend between an intermediate segment 230 and the inner perimeter segment 226. A ramp segment 121 extends between ramps 120. Additional segments 232 extend between one of the ramps 120 and one of the side perimeter segments 228. Secondary segments 234 extend between the outer perimeter segment 224 and the intermediate segment 230.

Any of the platform segment patterns shown are not intended to be limiting for any of the platform segments, as long as the weight of the platform segments is reduced while still maintaining the requisite strength of the platform segment.

Figure 8:
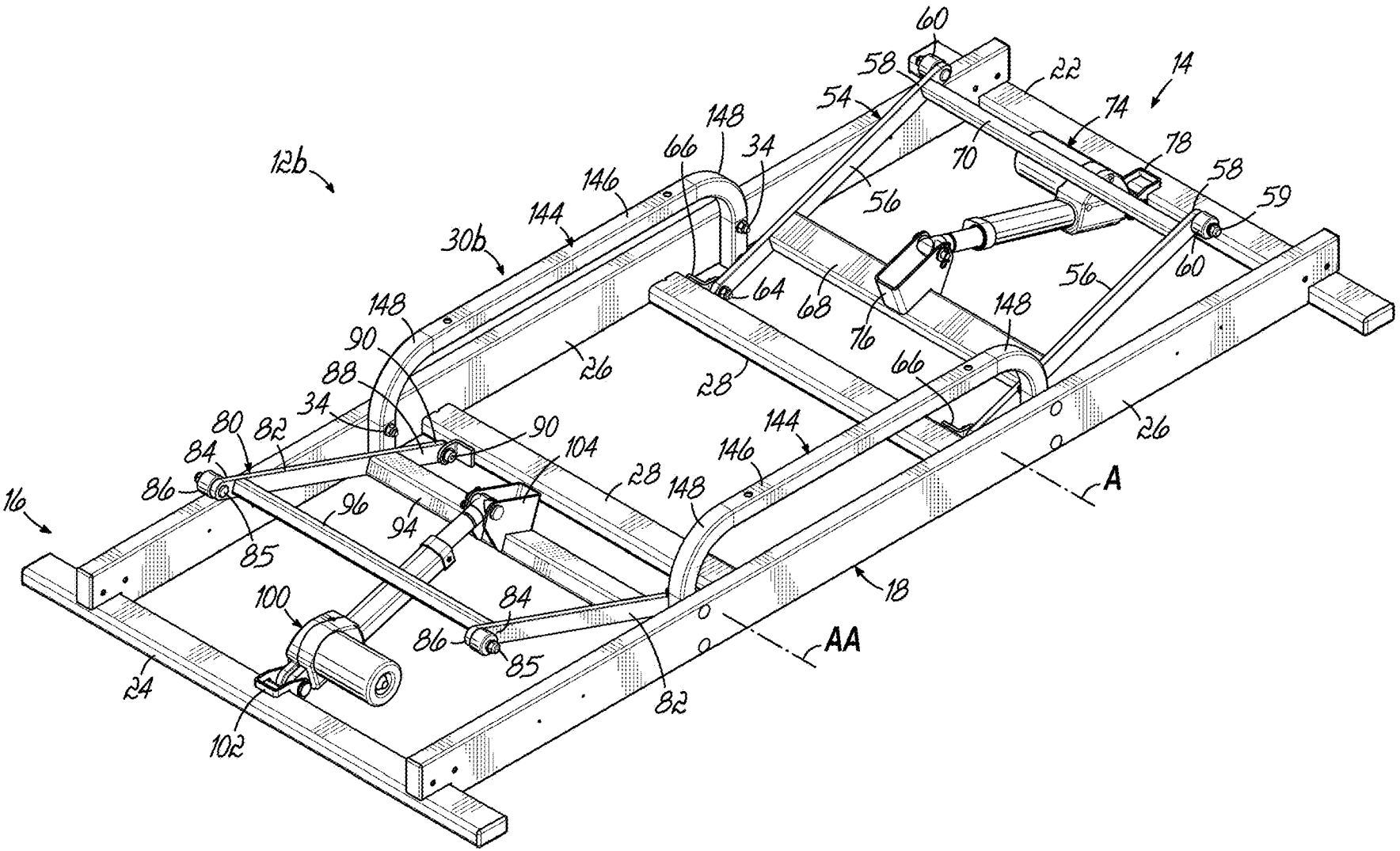
FIG. 8 is a top perspective view of an alternative embodiment of adjustable bed base.

FIG. 8 illustrates a different embodiment of adjustable bed base 12*b*. For simplicity, like parts have like numbers, some with a "b" designation. The adjustable bed base 12*b* has a head end 14 and a foot end 16. The adjustable bed base 12*b* may be used with any type of mattress (not shown).

As best shown in FIG. 8, the adjustable bed base 12*b* is similar to adjustable bed base 12, shown in FIGS. 1-5E, but has a different riser. The adjustable bed base 12*b*, in place of riser 30, has a riser 30*b* comprising two U-shaped braces 144 secured to the cross rails 28 of the stationary frame 18. Each of the U-shaped braces 144 extends parallel to one of the side rails 26 of the stationary frame 18 and is spaced above the side rail 26 of the stationary frame 18. Each of the U-shaped braces 144 comprises a linear top portion 146 and two curved end portions 148, each curved end portion 148 being secured to one end of the top linear portion 146. Each of the curved end portions 148 may be a separate piece from a piece comprising the top linear portion 146. Alternatively, each of the U-shaped braces may be a single unitary piece or made of any number of pieces. Each of the U-shaped braces 144 is secured to one of the side rails 26 of the stationary frame 18 with fasteners 34 which may alternatively be welds. Adjustable bed base 12*b* is similar to the adjustable bed bases shown and described in U.S. patent application Ser. No. 18/795,507, which is fully incorporated herein.

Figure 11A:
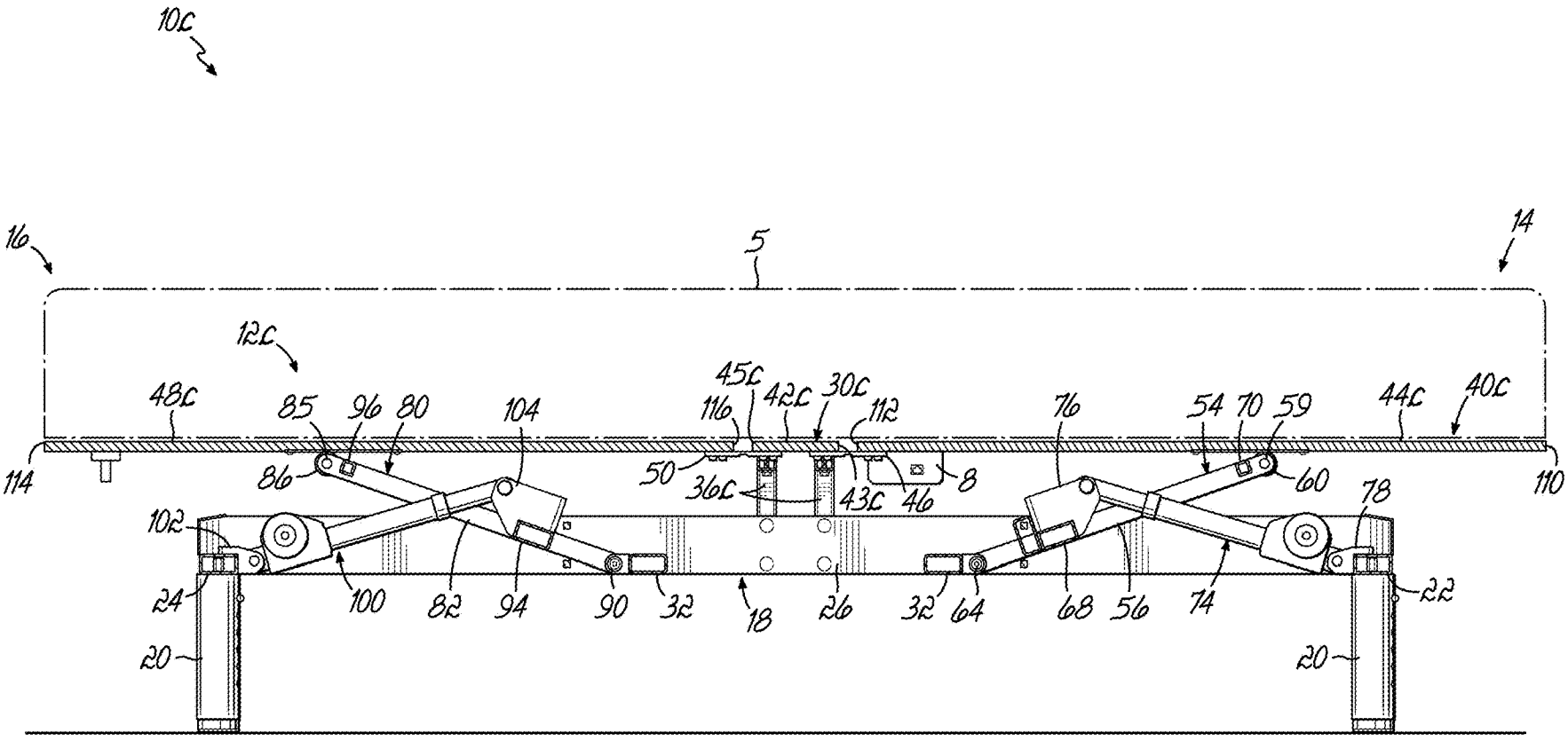
FIG. 11A is a side view, partially in cross-section, of the adjustable bed base of FIG. 10 showing the head platform section in a horizontal position and the foot platform section in a horizontal position.
Figure 11B:
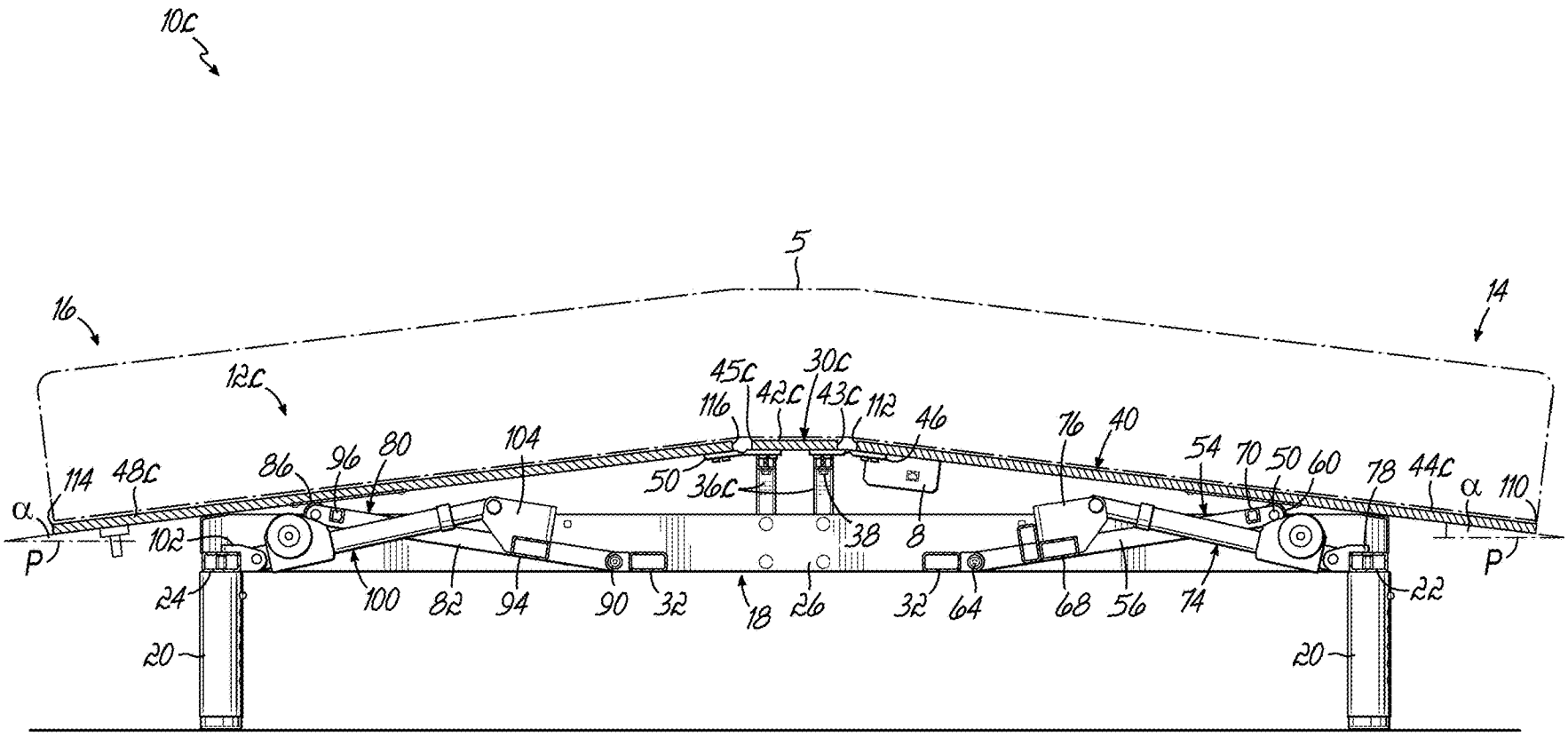
FIG. 11B is a side view, partially in cross-section, of the adjustable bed base of FIG. 10 showing the head platform section in a declined position and the foot platform section in a declined position.
Figure 12:
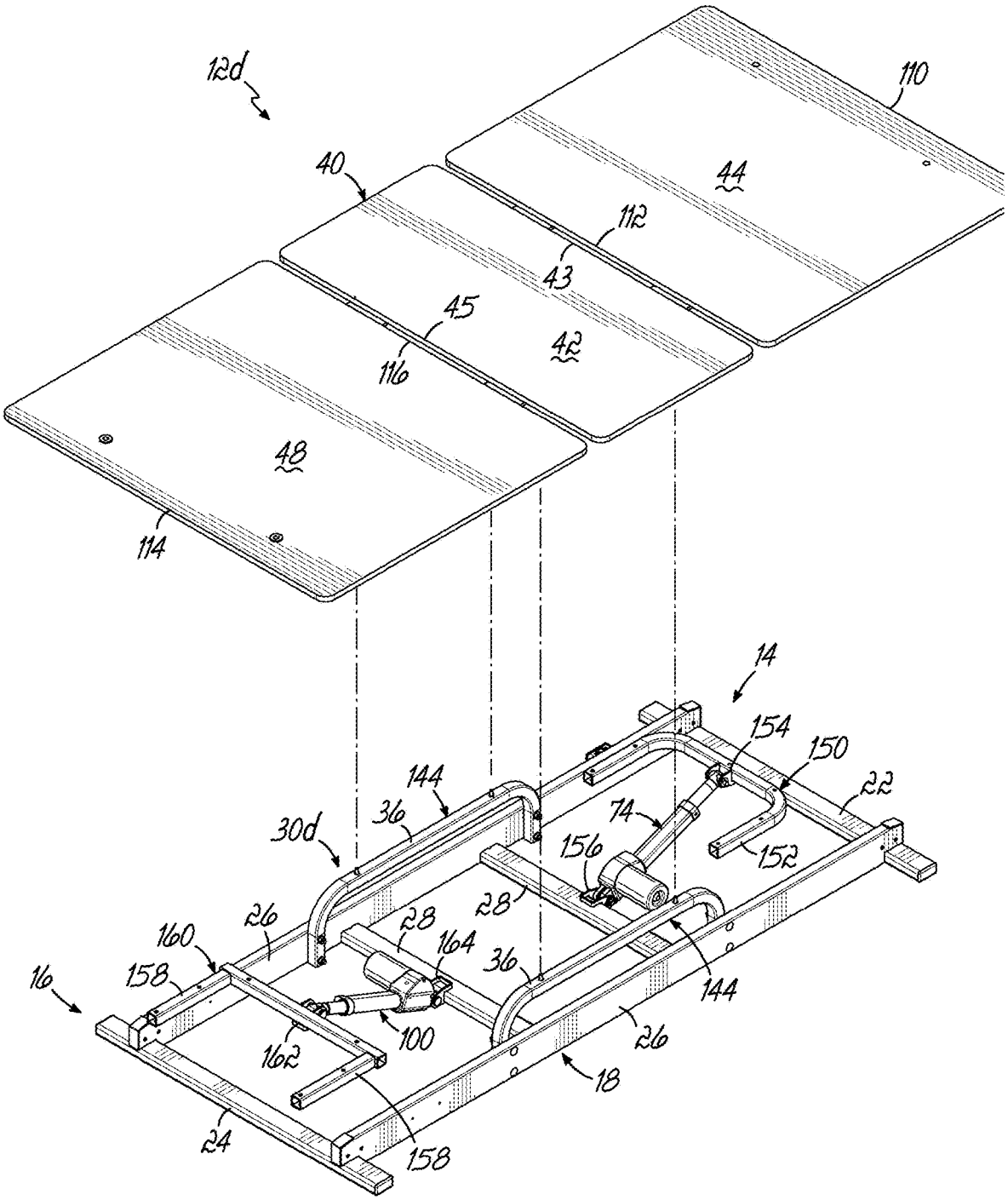
FIG. 12 is a partially disassembled view of another embodiment of adjustable bed base.

FIGS. 9-11B illustrate a different embodiment of adjustable bed base 12*c* for use in an adjustable bed 10*c*. The adjustable bed base 12*c* is similar to adjustable bed base 12. For simplicity, like parts have like numbers, some with a "c" designation. The adjustable bed base 12*c* has a head end 14 and a foot end 16. The adjustable bed base 12*c* may be used with a mattress 5, as shown in FIGS. 11A and 11B.

Adjustable bed base 12*c* has a different articulating platform 40*c* than the articulating platform 40 of adjustable bed base 12. The articulating platform 40*c* comprises a seat platform section 42*c*, a head platform section 44*c* hinged to the seat platform section 42*c* with hinges 46 and a foot platform section 48*c* hinged to the seat platform section 42*c* with hinges 50. The head platform section 44*c* has a front edge 110 and a rear edge 112. The foot platform section 48*c* has a front edge 116 and a rear edge 114.

Figure 9:
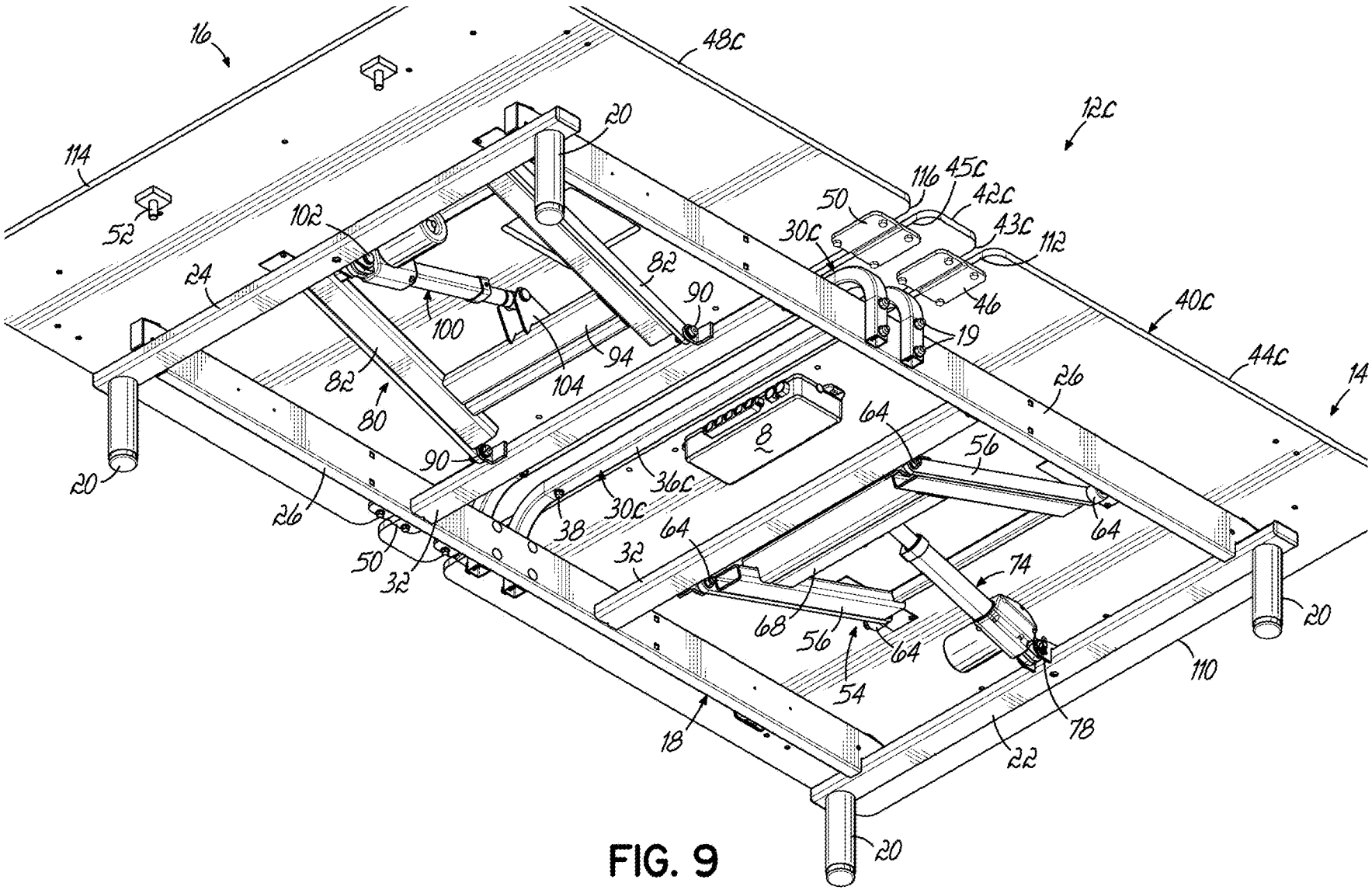
FIG. 9 is a bottom perspective view of an alternative embodiment of adjustable bed base.
Figure 10:
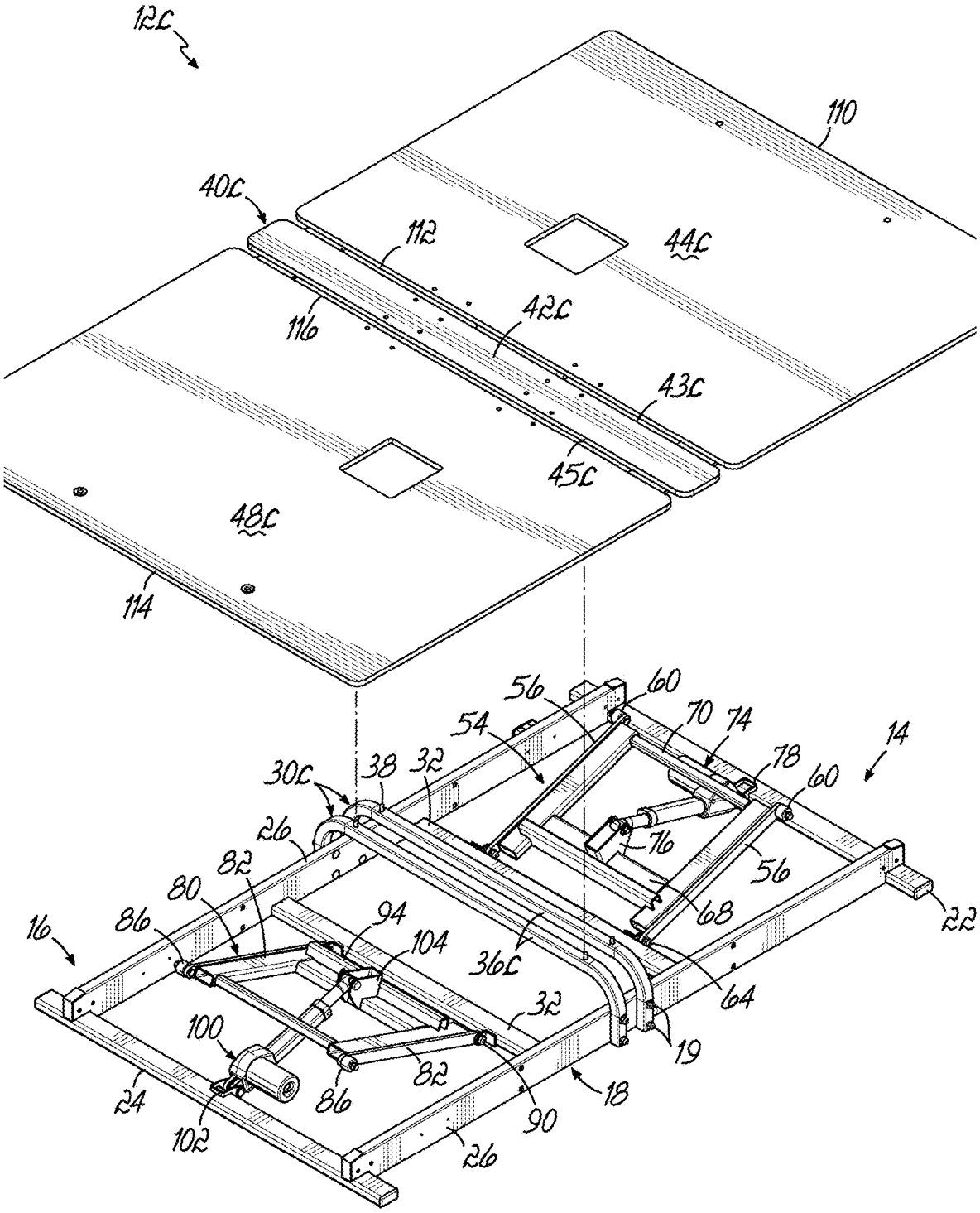
FIG. 10 is a partially disassembled view of the adjustable bed base of FIG. 9.

As best shown in FIGS. 9, 11A and 11B, the adjustable bed base 12*c* further comprises a control box 8 which is shown secured to the head seat platform section 44*c*. Although shown in one location, the control box 8 may be secured at any other desired location on the adjustable bed base 12*c* including being incorporated into one of the motorized linear actuators. Alternatively, the control box 8 may be located spaced from the adjustable bed base 12*c*. Such a control box 8 may be incorporated into any of the embodiments shown or described herein. The function and further details of the control box 8 may be found in U.S. patent application Ser. No. 18/795,507, which is fully incorporated herein.

The seat platform section 42*c* is secured to two arcuate braces 36*c* with fasteners 38 and does not move when the platform 40*c* is articulated. See FIGS. 11A-11B. The two arcuate braces 36*c* are secured to the side rails 26 of the frame 18 with fasteners 19. Each of the arcuate braces 36*c* extends from one side rail 26 to the other side rail 26. The two arcuate braces 36*c* are generally parallel the head rail 22 and foot rail 24. The arcuate braces 36*c* together comprise a riser 30*c*. The middle or seat platform section 42*c* is substantially narrower than the seat platform section 42 of the articulating platform 40 of the adjustable bed base 12. The middle or seat platform section 42*c* is substantially narrower than the head and foot platform sections 44*c*, 48*c* of the articulating platform 40*c* of the adjustable bed base 12*c*.

As shown in FIG. 9, although two hinges 46, 50 are shown securing adjacent platform sections, any other number of hinges may be used. The seat platform section 42*c* has a front edge 43*c* closest to the head platform section 48*c* and a rear edge 45*c* closest to the foot platform section 48*c*.

FIGS. 9 and 11A illustrates the adjustable bed base 12*c* is in its "home" position in which the articulating platform 40*c* is in a horizontal position. FIG. 11B illustrates the adjustable bed base 12*c* is in its "down" position in which the articulating platform 40*c* is in a downwardly bowed or curved position. Although not shown, the articulating platform 40*c* of adjustable bed base 12*c* may further assume any of the positions like the positions shown in FIGS. 5B-5D.

When the adjustable bed base 12*c* is in its "down" position shown in FIG. 11B, the articulating platform 40*c* is in a generally inverted U-shaped configuration. In this inverted U-shaped configuration, the outer edges 110, 114 of the articulating platform 40*c* are generally co-planar in a plane P, the head and foot platform sections 44*c*, 48*c* each being declined at an angle at an angle θ which may be up to six degrees relative to horizontal. When the adjustable bed base 12*c* is in its "down" position shown in FIG. 11B, the front edge 110 of the head platform section 44*c* is below the rear edge 112 of the head platform section 44*c*. When the adjustable bed base 12*c* is in its "down" position shown in FIG. 11B, the rear edge 114 of the foot platform section 48*c* is below the front edge 116 of the foot platform section 48*c*. When the adjustable bed base 12*c* is in its "down" position shown in FIG. 11B, the seat platform section 42*c* remains horizontal with the front and rear edges 43*c*, 45*c* remaining coplanar in a plane above the plane P described above.

Figure 13:
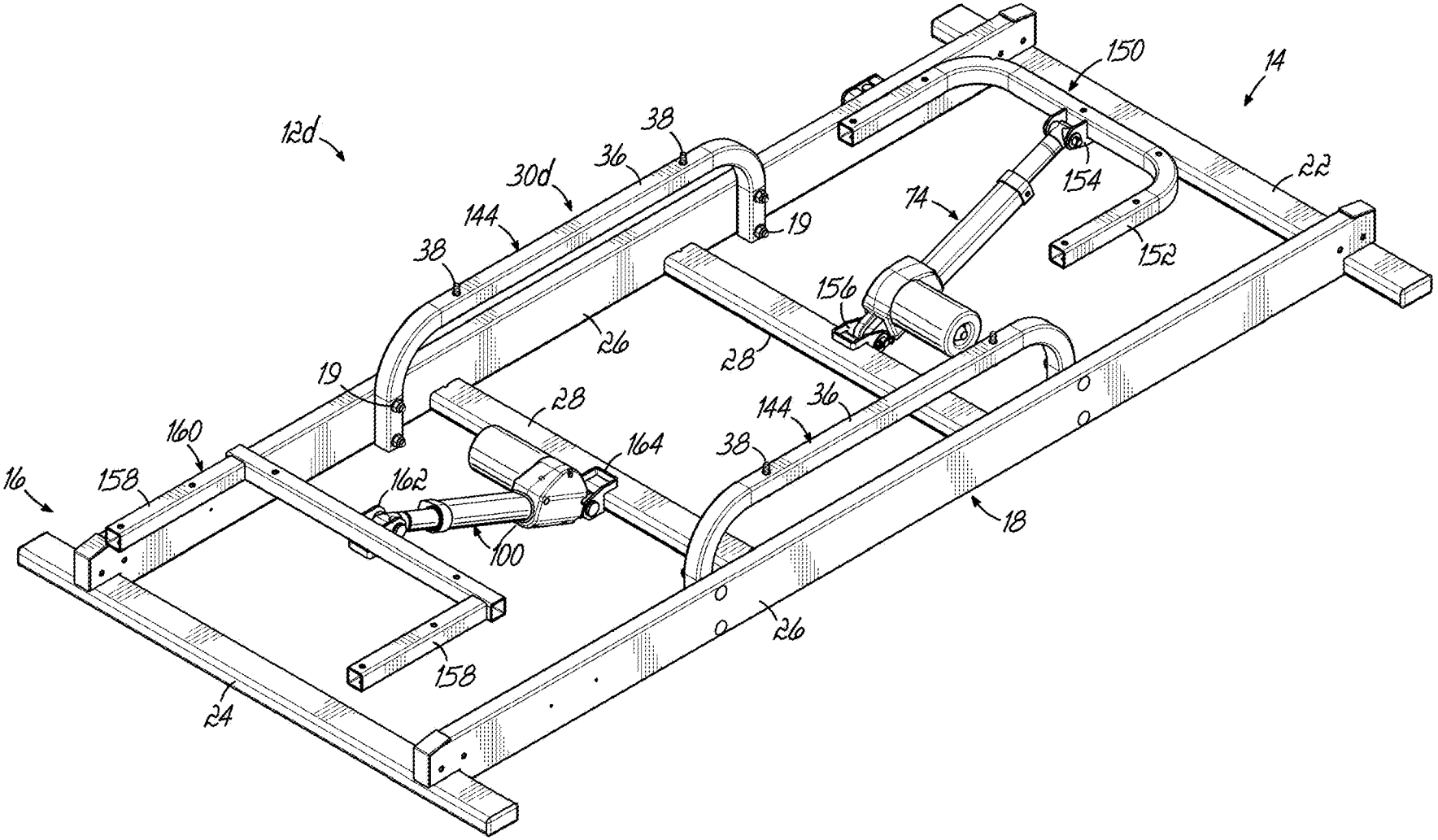
FIG. 13 is a top perspective view of the adjustable bed base of FIG. 12.
Figure 14A:
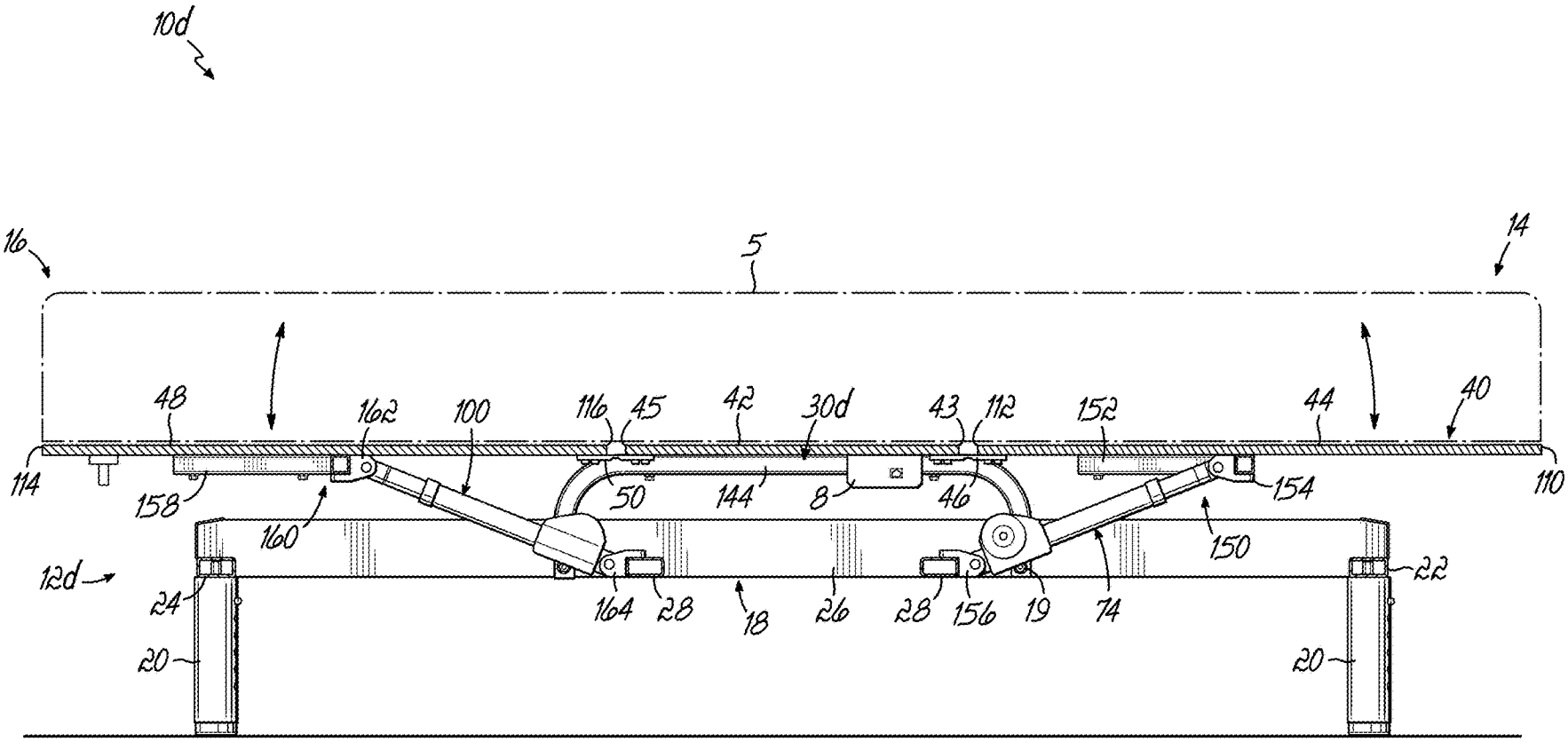
FIG. 14A is a side view, partially in cross-section, of the adjustable bed base of FIG. 13 showing the head platform section in a horizontal position and the foot platform section in a horizontal position.
Figure 14B:
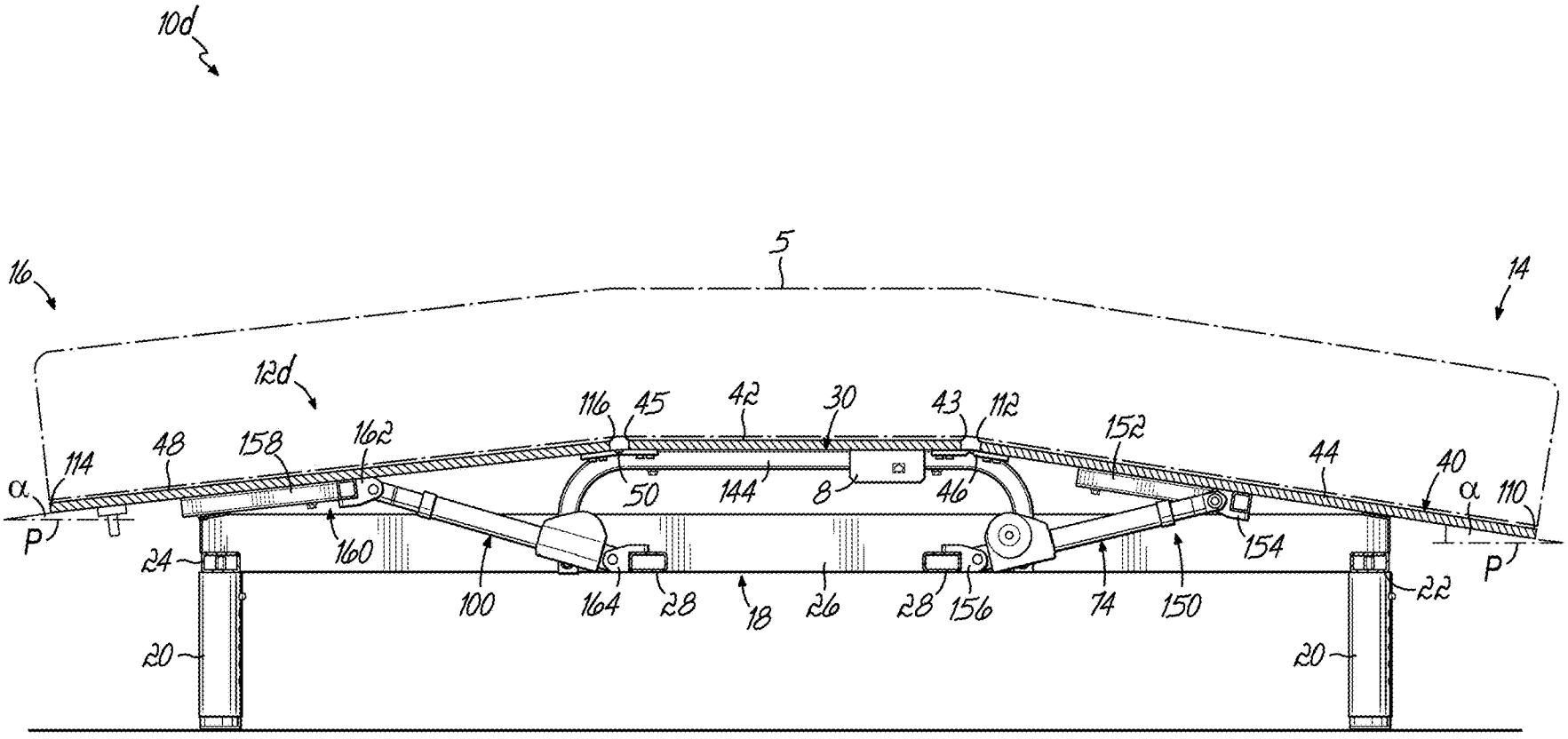
FIG. 14B is a side view, partially in cross-section, of the adjustable bed base of FIG. 13 showing the head platform section in a declined position and the foot platform section in a declined position.

FIGS. 12-14B illustrate a different embodiment of adjustable bed base 12*d* for use in an adjustable bed 10*d*. The adjustable bed base 12*d* is similar to adjustable bed base 12*b* shown in FIG. 8. For simplicity, like parts have like numbers, some with a "d" designation. The adjustable bed base 12*d* has a head end 14 and a foot end 16. The adjustable bed base 12*d* may be used with a mattress 5, as shown in FIGS. 14A and 14B. The adjustable bed base 12*d* has a generally rectangular stationary frame 18 comprising a head rail 22, a foot rail 24 and two opposed side rails 26. The stationary frame 18 further comprises two cross rails 28 secured to the side rails 26 of the stationary frame 18, each cross rail 28 extending between the side rails 26 of the stationary frame 18.

A U-shaped brace 144, like those shown in FIG. 8, is secured to each of the side rails 26. Together, the U-shaped braces 144 form a riser 30*d* to which the seat platform section 42 is secured. However, any other riser shown or described herein may be used.

The adjustable bed base 12*d* further comprises an articulating platform 40 comprising a seat platform section 42 secured to the braces 144 with fasteners 38. The seat platform section 42 does not move when the platform 40 is articulated. See FIGS. 14A-14B. A head platform section 44 is hinged to the seat platform section 42 with hinges 46. Lastly, a foot platform section 48 is hinged to the seat platform section 42 with hinges 50. Although the platform sections 42, 44 and 48 are shown being solid pieces, one or more of them may have openings therethrough. The drawings are not intended to be limiting. Similarly, although the head and foot platform sections 44, 48 are illustrated being approximately the same size, the size of any of the platform sections is not intended to be limited by the drawings.

Although two hinges are shown securing adjacent platform sections, any other number of hinges may be used. The seat platform section 42 has a front edge 43 closest to the head platform section 48 and a rear edge 45 closest to the foot platform section 48. The head platform section 44 has a front edge 110 and a rear edge 112. The foot platform section 48 has a front edge 116 and a rear edge 114.

The adjustable bed base 12*d* further comprises a front pusher assembly 150 including a motorized front linear actuator 74 for moving (inclining or declining) the head platform section 44. The front pusher assembly 150 is different than the front pusher assembly 54 used in other embodiments shown or described herein in several ways including a lack of wheels. The front pusher assembly 150 comprises a front strengthener 152 which is secured to the head platform section 44 underneath the head platform section 44. Although the front strengthener 152 is illustrated being generally U-shaped, it may be any desired shape.

As best shown in FIG. 13, the motorized front linear actuator 74 has a front end pivotally secured to a mounting bracket 154 welded or otherwise secured to the front strengthener 152. The mounting bracket 154 may be considered an integral part of the front strengthener 152 in some instances. For example, the front strengthener 152 may have two ears welded thereto between which a pin extends to secure the motorized front linear actuator 74 to the front strengthener 152. The motorized front linear actuator 74 has a rear end pivotally secured to a mounting bracket 156 welded or otherwise secured to the front one of the two cross rails 28. The mounting bracket 156 may be considered an integral part of the front cross rail 28 in some instances. For example, the front one of the two cross rails 28 may have two ears welded thereto between which a pin extends to secure the motorized front linear actuator 74 to the front one of the two cross rails 28.

The adjustable bed base 12*d* further comprises a rear pusher assembly 160 including a motorized rear linear actuator 100 for moving (inclining or declining) the foot platform section 48. The rear pusher assembly 160 is different than the rear pusher assembly 80 used in other embodiments shown or described herein in many ways including a lack of wheels. The rear pusher assembly 160 comprises a rear strengthener 158 which is secured to the foot platform section 48 underneath the foot platform section 48. Although the rear strengthener 158 is illustrated being generally U-shaped, it may be any desired shape.

As best shown in FIG. 13, the motorized rear linear actuator 100 has a rear end pivotally secured to a mounting bracket 162 welded or otherwise secured to the U-shaped rear strengthener 158. The mounting bracket 162 may be considered an integral part of the rear strengthener 158 in some instances. For example, the rear strengthener 158 may have two ears welded thereto between which a pin extends to secure the motorized rear linear actuator 100 to the rear strengthener 158. The motorized rear linear actuator 100 has a front end pivotally secured to a mounting bracket 164 welded or otherwise secured to the rear one of the two cross rails 28. The mounting bracket 164 may be considered an integral part of the rear cross rail 28 in some instances. For example, the rear one of the two cross rails 28 may have two ears welded thereto between which a pin extends to secure the motorized rear linear actuator 100 to the rear one of the two cross rails 28.

Although the front and rear stabilizers 152, 158 are shown having certain shapes, either of them may be any other desired shape. Although each of the front and rear stabilizers 152, 158 are shown comprising multiple pieces, one or both may be made of a unitary piece. The drawings are not intended to be limiting.

FIG. 14A illustrates the adjustable bed base 12*d* is in its "home" position in which the articulating platform 40 is in a horizontal position. FIG. 14B illustrates the adjustable bed base 12*d* is in its "down" position in which the articulating platform 40 is in a downwardly bowed or curved position. Although not shown, the articulating platform 40 of adjustable bed base 12*d* may further assume any of the positions like the positions shown in FIGS. 5B-5D.

When the adjustable bed base 12*d* is in its "down" position shown in FIG. 14B, the articulating platform 40 is in a generally inverted U-shaped configuration. In this inverted U-shaped configuration, the outer edges 110, 114 of the articulating platform 40 are generally co-planar in a plane P, the head and foot platform sections 44, 48 each being declined at an angle at an angle θ which may be up to six degrees relative to horizontal. When the adjustable bed base 12*d* is in its "down" position shown in FIG. 14B, the front edge 110 of the head platform section 44 is below the rear edge 112 of the head platform section 44. When the adjustable bed base 12 is in its "down" position shown in FIG. 14B, the rear edge 114 of the foot platform section 48 is below the front edge 116 of the foot platform section 48. When the adjustable bed base 12*d* is in its "down" position shown in FIG. 14B, the seat platform section 42 remains horizontal with the front and rear edges 43, 45 remaining coplanar in a plane above the plane P described above.

Figure 15:
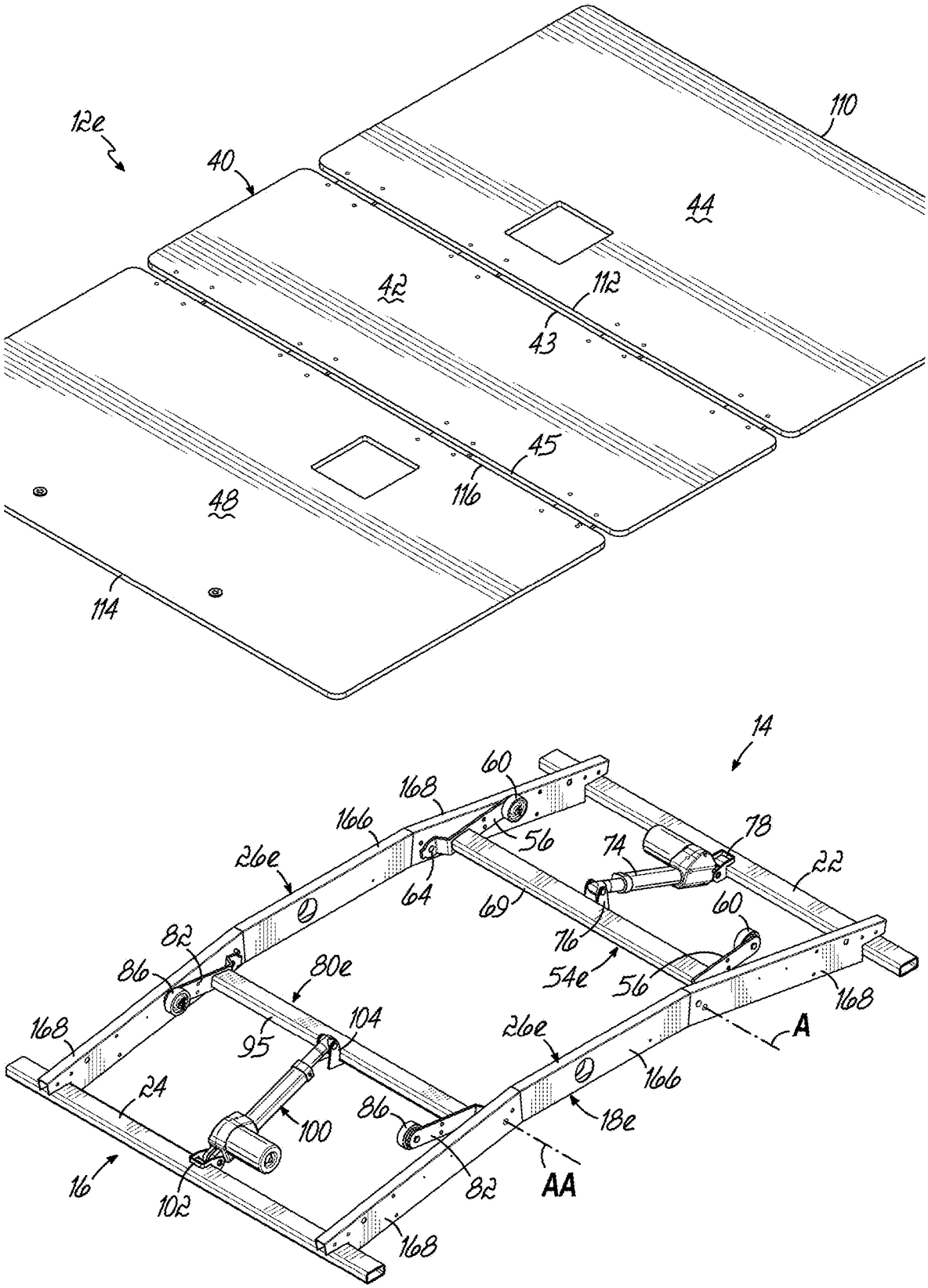
FIG. 15 is a partially disassembled view of another embodiment of adjustable bed base.
Figure 16:
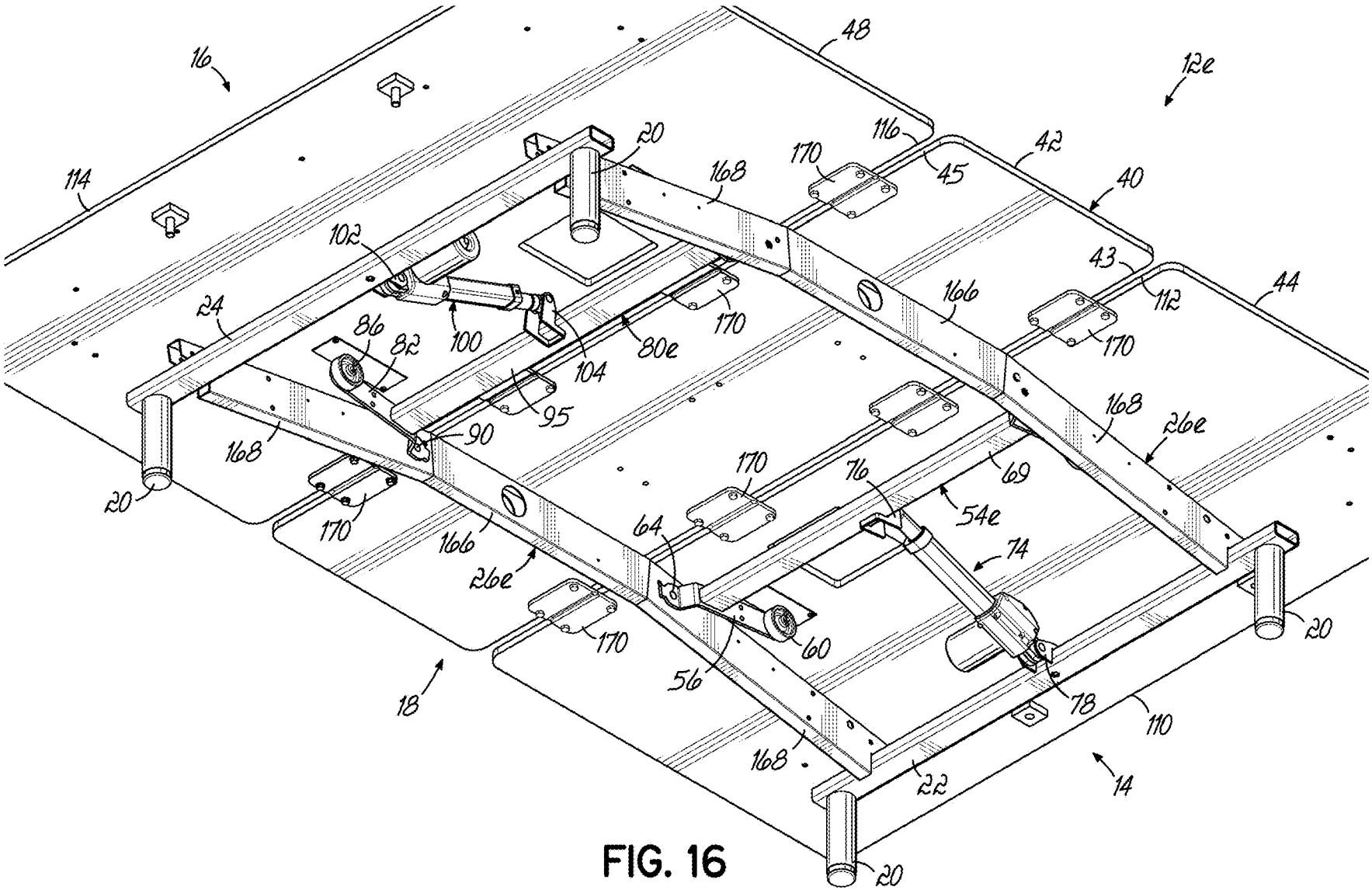
FIG. 16 is a bottom perspective view of the adjustable bed base of FIG. 15.
Figure 17A:
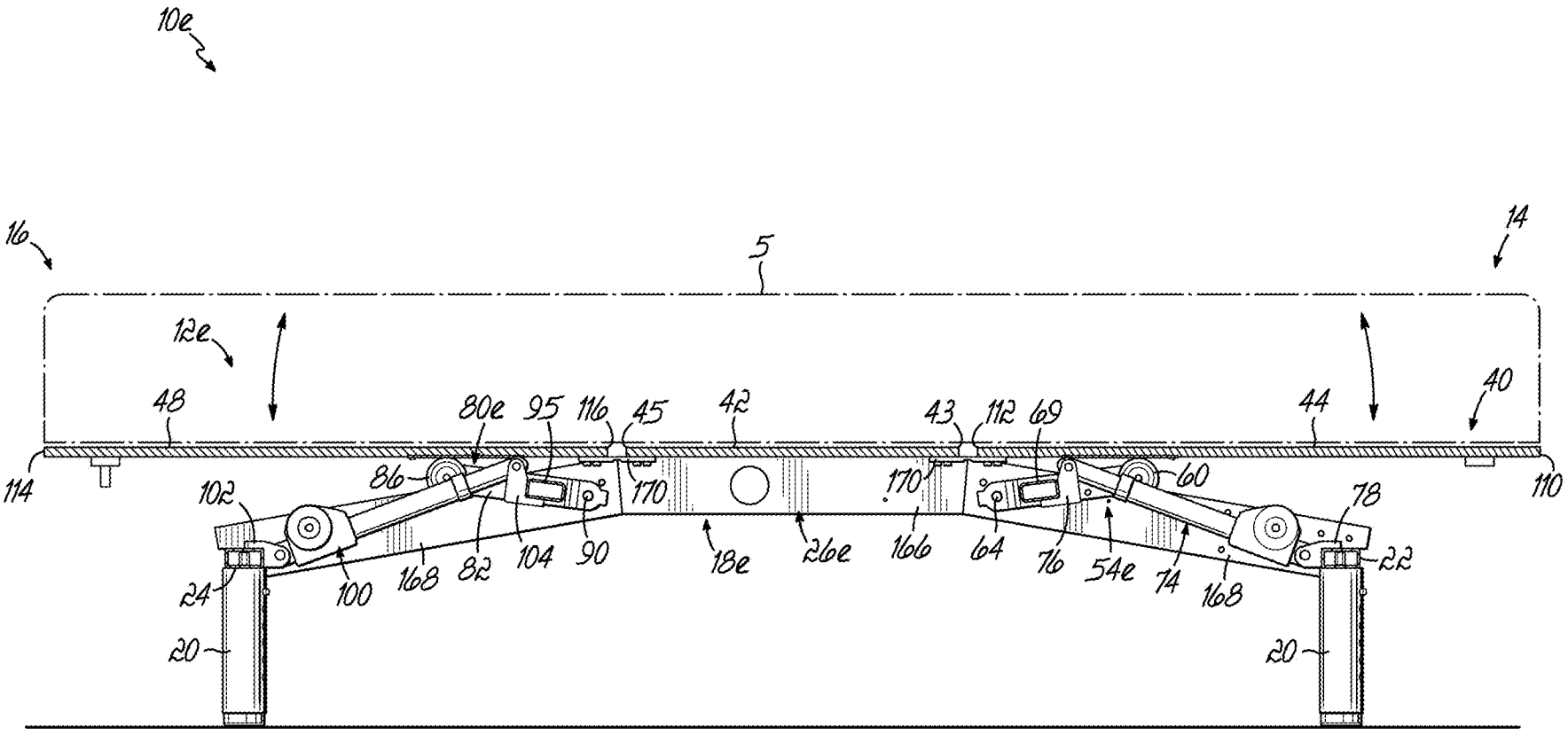
FIG. 17A is a side view, partially in cross-section, of the adjustable bed base of FIG. 16 showing the head platform section in a horizontal position and the foot platform section in a horizontal position.
Figure 17B:
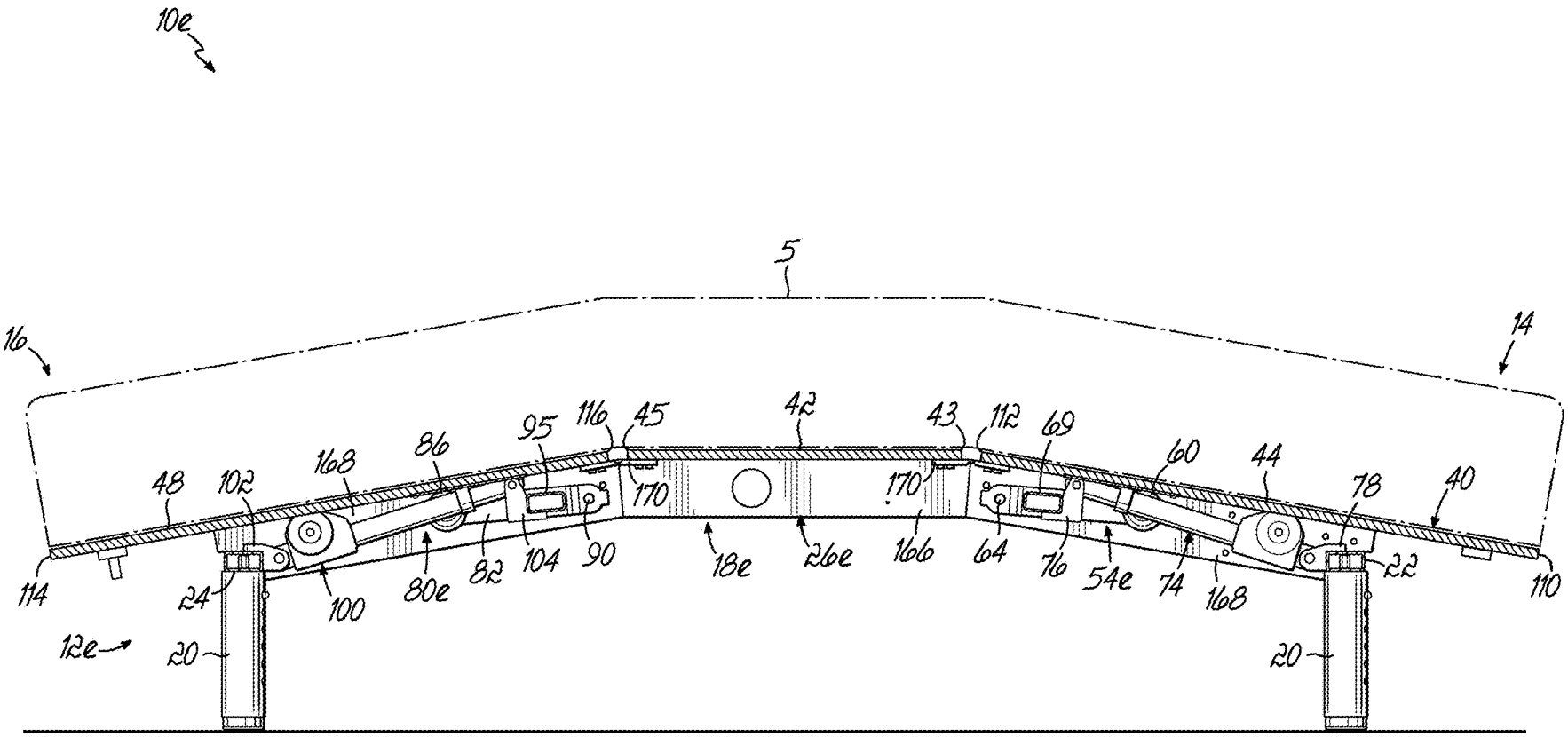
FIG. 17B is a side view, partially in cross-section, of the adjustable bed base of FIG. 16 showing the head platform section in a declined position and the foot platform section in a declined position.

FIGS. 15-17B illustrate a different embodiment of adjustable bed base 12*e* for use in an adjustable bed 10*e*. For simplicity, like parts have like numbers, some with an "e" designation. The adjustable bed base 12*e* has a head end 14 and a foot end 16. The adjustable bed base 12*e* may be used with any type of mattress 5, as shown in FIGS. 17A and 17B.

Adjustable bed base 12*e* is shown having the same articulating platform 40 as the adjustable bed base 12. However, the adjustable bed base 12*e* is shown having a different stationary frame 18*e* than the stationary frame 18. Adjustable bed base 12*e* has a front pusher assembly 54*e* similar to front pusher assembly 54 of adjustable bed base 12. Adjustable bed base 12*e* has a rear pusher assembly 80*e* similar to the rear pusher assembly 80 of adjustable bed base 12.

The stationary frame 18*e* comprises a head rail 22, a foot rail 24 and two opposed side rails 26*e*. Rather than being straight or linear, each of the side rails 26*e* has a straight or linear middle section 166 and two end sections 168. Each of the end sections 168 is straight and extends outwardly and downwardly from one end of the middle section 166. Therefore, each of the side rails 26*e* may considered to be generally U-shaped.

As shown in FIG. 16, although four hinges 170 are shown securing adjacent platform sections, any other number of hinges may be used. The seat platform section 42 has a front edge 43 closest to the head platform section 48 and a rear edge 45 closest to the foot platform section 48. The head platform section 44 has a front edge 110 and a rear edge 112. The foot platform section 48 has a front edge 116 and a rear edge 114.

FIGS. 15 and 16 illustrate front pusher assembly 54*e* which comprises a front linear actuator 74, two arms 56 and a stabilizer 69 extending between the arms 56. Each of the arms 56 has a first end to which a rotatable wheel 60 is secured. Each of the arms 56 has a second end which is pivotally secured to one of the side rails 26*e* of the stationary frame 18*e* with a pin 64 such that the arm 56 pivots about an axis, as shown in FIG. 16. Alternatively, any front pusher assembly shown or described herein may be used in this embodiment.

The rear pusher assembly 80*e* comprises two links 82 and a stabilizer 95 extending between the links 82. Each of the links 82 has a first end 84 to which a rotatable wheel 86 is secured. Each of the links 82 has a second end which is pivotally secured to one of the side rails 26 of the stationary frame 18 with a pin 90 such that the arm pivots about an axis, as shown in FIG. 16. Alternatively, any rear pusher assembly shown or described herein may be used in this embodiment.

FIG. 17A illustrates the adjustable bed base 12*e* is in its "home" position in which the articulating platform 40 is in a horizontal position. FIG. 17B illustrates the adjustable bed base 12*e* is in its "down" position in which the articulating platform 40 is in a downwardly bowed or curved position. Although not shown, the articulating platform 40 of adjustable bed base 12*e* may further assume any of the positions like the positions shown in FIGS. 5B-5D.

When the adjustable bed base 12*e* is in its "down" position shown in FIG. 17B, the articulating platform 40 is in a generally inverted U-shaped configuration. In this inverted U-shaped configuration, the outer edges 110, 114 of the articulating platform 40 are generally co-planar in a plane P, the head and foot platform sections 44, 48 each being declined at an angle at an angle θ which may be up to six degrees relative to horizontal. When the adjustable bed base 12*d* is in its "down" position shown in FIG. 17B, the front edge 110 of the head platform section 44 is below the rear edge 112 of the head platform section 44. When the adjustable bed base 12*e* is in its "down" position shown in FIG. 17B, the rear edge 114 of the foot platform section 48 is below the front edge 116 of the rear platform section 48. When the adjustable bed base 12*e* is in its "down" position shown in FIG. 17B, the seat platform section 42 remains horizontal with the front and rear edges 43, 45 remaining coplanar in a plane above the plane P described above.

Lastly, when the adjustable bed base 12*e* is in its "down" position shown in FIG. 17B, the different sections of the articulating platform 40 are supported by and rest on the different sections of the frame 18*e*. As seen in FIG. 17B, the head platform section 44, in its "down" position, rests upon or is supported by the end sections 168 of the side rails 26*e*. Similarly, the foot platform section 48 in its "down" position rests upon or is supported by the end sections 168 of the side rails 26*e*. Regardless of the positions of the head and foot sections 44, 48 of the articulating platform 40, the seat section 42 is secured to the middle sections 166 of the side rails **26*e* as shown in FIGS. 17A and 17**B.

Figure 18:
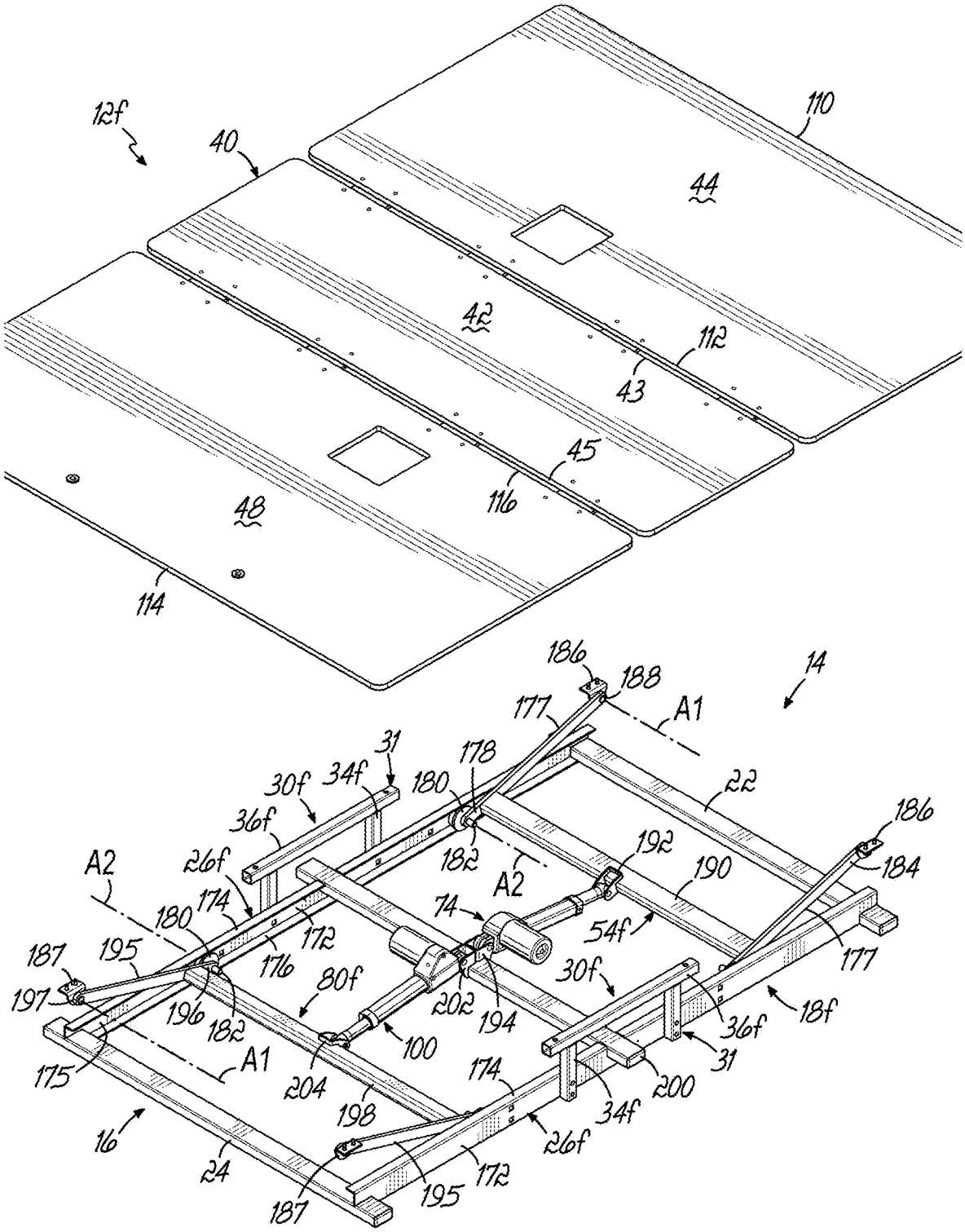
FIG. 18 is a partially disassembled view of another embodiment of adjustable bed base.
Figure 19A:
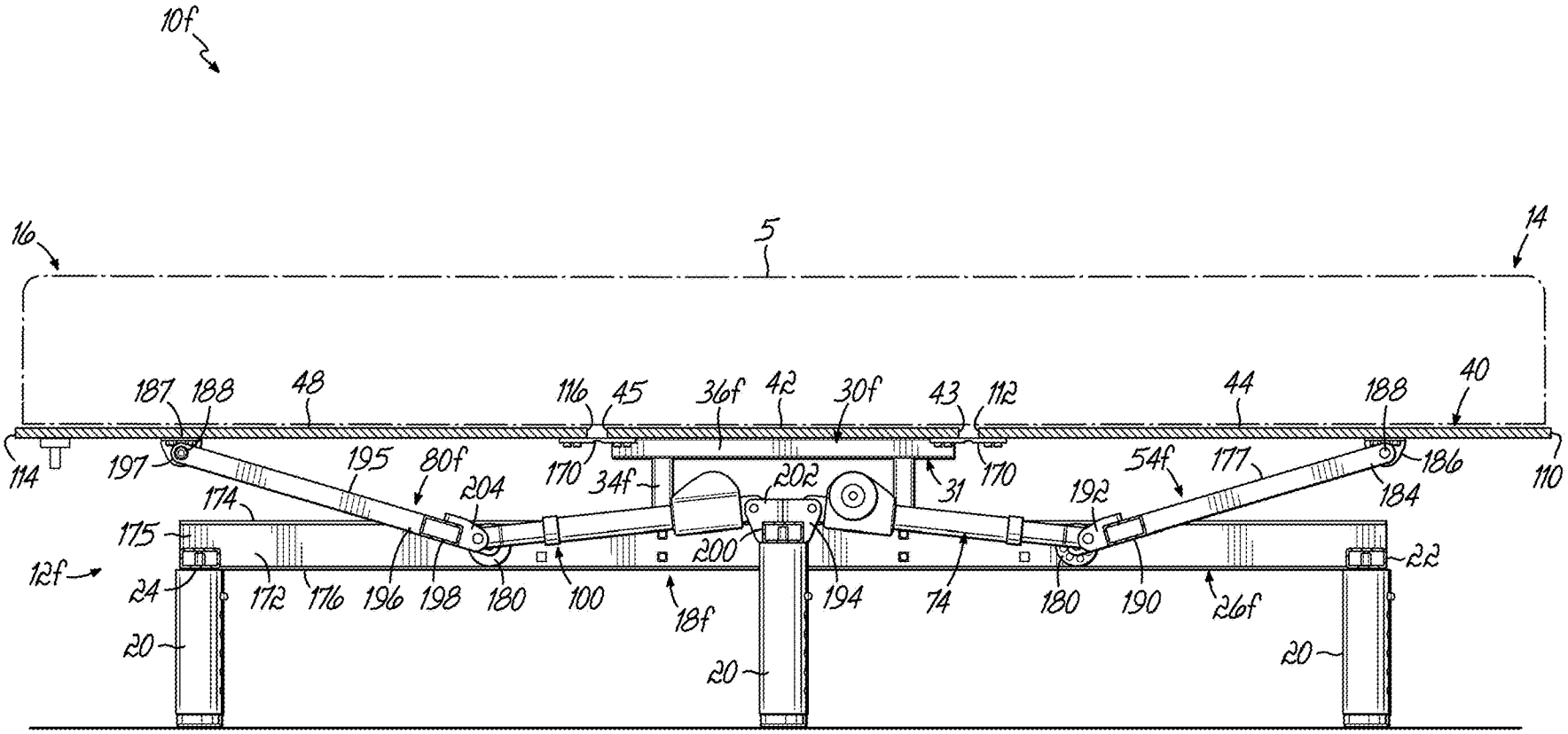
FIG. 19A is a side view, partially in cross-section, of the adjustable bed base of FIG. 18 showing the head platform section in a horizontal position and the foot platform section in a horizontal position.
Figure 19B:
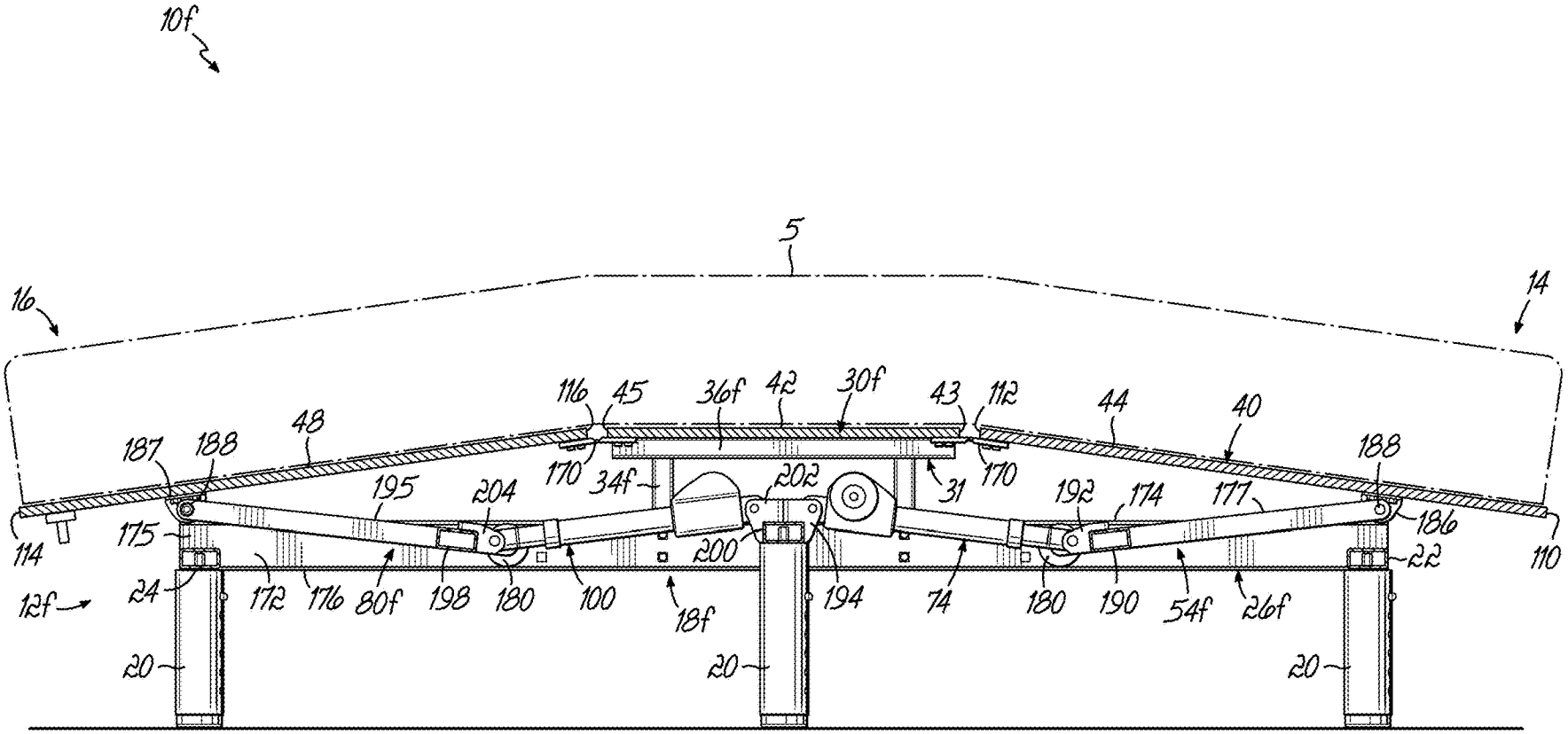
FIG. 19B is a side view, partially in cross-section, of the adjustable bed base of FIG. 18 showing the head platform section in a declined position and the foot platform section in a declined position.

FIGS. 18-19B illustrate a different embodiment of adjustable bed base **12*f* for use in an adjustable bed 10*f*. For simplicity, like parts have like numbers, some with an "f" designation. The adjustable bed base 12*f* has a head end 14 and a foot end 16. The adjustable bed base 12*f* may be used with any type of mattress 5, as shown in FIG. 19**.

Adjustable bed base **12*f* has an articulating platform 40 like that of adjustable bed base 12 with hinges 170 joining adjacent platform sections. However, the adjustable bed base 12*f* has a different stationary frame 18*f* than the other stationary frames. The adjustable bed base 12*f* also has a different front pusher assembly 54*f* than the other front pusher assemblies disclosed herein and a different rear pusher assembly 80*f*** than the other rear pusher assemblies disclosed herein.

The stationary frame **18*f* comprises a head rail 22, a foot rail 24, a cross rail 200 and two opposed side rails 26*f*. As best shown in FIGS. 19A and 19B, each of the side rails 26*f* comprises a sidewall 172, a top wall 174 and a bottom wall 176. The top and bottom walls 174, 176 extend outwardly from the side wall 172 and together with the side wall 172 form a C-shaped channel 175. Thus, each of the side rails 26*f*** is generally C-shaped in cross section.

The stationary frame **18*f* comprises a stationary riser 30*f* comprising two sides 31. Each side 31 of riser 30*f* comprises two stubs 34*f* and a brace 36*f* extending between the stubs 34*f* and secured thereto. The braces 36*f* of sides 31 are secured to seat platform section 42 of the articulating platform 40. The stubs 34*f* of each side 31 are secured to one of the side rails 26*f* of the stationary frame 18*f*. As shown in FIG. 18, the stationary cross rail 200 extends between the stubs 34*f* on each side of the stationary frame 18*f***.

The adjustable bed base **12*f* further comprises a front pusher assembly 54*f* for moving the head platform section 44. The front pusher assembly 54*f* comprises two arms 177. As best shown in FIG. 18, each of the arms 177 has a first end 178 to which a rotatable wheel 180 is secured with a pin 182. Each of the rotatable wheels 180 travels inside one of the channels 175 of one of the side rails 26*f***.

Each of the arms 177 has a second end 184 which is pivotally secured to a mounting bracket 186 with a pin 188 such that the arm 177 pivots about an axis A1. Each of the mounting brackets 186 is secured to the head platform section 44. As best shown in FIG. 18, the front pusher assembly **54*f* of the adjustable bed base 12*f* further comprises a stabilizer 190 extending between the arms 177. The stabilizer 190 is shown close to the rotatable wheels 180 but may be any other logical location extending between the arms 177. The stabilizer 190** is shown as a hollow member but may be a solid or partially solid member.

As best shown in FIG. 18, the front pusher assembly **54*f* of the adjustable bed base 12*f* further comprises a motorized front linear actuator 74 for moving (inclining or declining) the head platform section 44. The motorized front linear actuator 74 has a front or first end pivotally secured to a mounting bracket 192 secured to the stabilizer 190 of the front pusher assembly 54*f*. The motorized front linear actuator 74 has a rear or second end pivotally secured to a mounting bracket 194 secured to the cross rail 200 of the stationary frame 18*f*. Although the mounting brackets 192, 194** are shown having certain shapes, either mounting bracket may be any other desired shape. Again, the drawings are not intended to be limiting.

As best shown in FIG. 18, the adjustable bed base **12*f* further comprises a rear pusher assembly 80*f* for moving (inclining or declining) the foot platform section 48. The rear pusher assembly 80*f* comprises two links 195. Each of the links 195 has a first end 196 to which a rotatable wheel 180 is secured with a pin 182. Each of the links 195 has a second end 197 which is pivotally secured a mounting bracket 187 with a pin 188 such that the link 195 pivots about an axis A2, as shown in FIG. 18. Each of the mounting brackets 187 is secured to the foot platform section 44**.

As best shown in FIG. 18, the rear pusher assembly **80*d* of the adjustable bed base 12*f* further comprises a stabilizer 198 extending between the links 195. The stabilizer 198 is shown close to the rotatable wheels 180 but may be any other logical location extending between the links 195. The stabilizer 198 is each shown as a hollow member but either may be a solid or partially solid member. Although the stabilizers 190, 198** are shown having certain shapes, either stabilizer may be any other desired shape. The drawings are not intended to be limiting.

As best shown in FIG. 18, the rear pusher assembly **80*d* of the adjustable bed base 12 further comprises a motorized rear linear actuator 100 for inclining or declining the foot platform section 48. The motorized rear linear actuator 100 has a front or first end pivotally secured to a mounting bracket 202 secured to the cross rail 200 of the stationary frame 18*f*. The motorized rear linear actuator 100 has a rear or second end pivotally secured to a mounting bracket 204 secured to the stabilizer 198 of the rear pusher assembly 80*f*. Although the mounting brackets 202, 204** are shown having certain shapes, either mounting bracket may be any other desired shape. Again, the drawings are not intended to be limiting.

Although the drawings of the adjustable bed base **12*f* show a front end of the motorized rear linear actuator 100 and a rear end of the motorized front linear actuator 74 each being secured to the same cross rail 200, the front end of the motorized rear linear actuator 100 and the rear end of the motorized front linear actuator 74** may be secured to different cross rails.

Although the drawings of the adjustable bed base **12*f* show riser 30*f* being like riser 30, the riser of this embodiment may be like riser 30*d* having two U-shaped braces 144**.

In any of the embodiments shown or described herein, in place of a mounting bracket, two ears may be integrally built into a cross member of a frame or an end rail of a frame with a pin extending between the ears to pivotally secure one end of a linear actuator thereto.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a stationary frame having opposed side rails, a head rail, and a foot rail;

a front cross rail extending between the opposed side rails of the stationary frame;

a rear cross rail extending between the opposed side rails of the stationary frame;

a riser comprising two opposed braces, each brace being secured to one of the side rails of the stationary frame, an articulating platform comprising multiple platform sections hinged together, at least one platform section being secured to the riser such that the at least one platform section is stationary above the stationary frame;

a front pusher assembly for moving a head platform section, the front pusher assembly comprising a front strengthener attached to one of the platform sections, the front pusher assembly further comprising a front linear actuator having a first end pivotally secured to a mounting bracket secured to the front cross rail and a second end pivotally secured to a mounting bracket secured to the front strengthener; and a rear pusher assembly for moving a foot platform section, the rear pusher assembly comprising a rear strengthener attached to one of the platform sections, the rear pusher assembly further comprising a rear linear actuator having a first end pivotally secured to a mounting bracket secured to the rear cross rail and a second end pivotally secured to a mounting bracket secured to the rear strengthener, wherein a front edge of the head platform section is below a rear edge of the head platform section when the front linear actuator is fully retracted and a rear edge of the foot platform section is below a front edge of the foot platform section when the rear linear actuator is fully retracted.

2. The adjustable bed base of claim 1, wherein at least one of the strengtheners is generally U-shaped.

3. The adjustable bed base of claim 1, wherein the riser comprises two arched members secured to the side rails of the stationary frame.

4. The adjustable bed base of claim 1, wherein the linear actuators are motorized.

5. The adjustable bed base of claim 1, wherein at least one of the platform sections is a solid member.

6. The adjustable bed base of claim 1, wherein at least one of the strengtheners comprises multiple pieces of metal joined together.

7. The adjustable bed base of claim 1, wherein the head and foot platform sections are inclined when the front and rear linear actuators are extended.

8. The adjustable bed base of claim 1, wherein the head and foot platform sections are declined when the front and rear linear actuators are retracted.

9. An adjustable bed base comprising:

a stationary frame having opposed side rails, a head rail, a front cross rail, a rear cross rail and a foot rail;

a riser secured to the stationary frame, an articulating platform comprising a stationary seat platform section secured to the riser, a head platform section hinged to one side of the stationary seat platform section and a foot platform section hinged to the opposite side of the stationary seat platform section;

a front pusher assembly for inclining and declining the head platform section, the front pusher assembly comprising a front strengthener attached to the head platform section, the front pusher assembly further comprising a front linear actuator having a first end pivotally secured to a mounting bracket secured to the front cross rail and a second end pivotally secured to the front strengthener; and a rear pusher assembly for inclining and declining the foot platform section, the rear pusher assembly comprising a rear strengthener attached to the foot platform section, the rear pusher assembly further comprising a rear linear actuator having a first end pivotally secured to a mounting bracket secured to the rear cross rail and a second end pivotally secured to the rear strengthener, wherein the head and foot platform sections are declined when the front and rear linear actuators are retracted and inclined when the front and rear linear actuators are extended.

10. The adjustable bed base of claim 9, further comprising legs secured to the stationary frame for supporting the stationary frame.

11. The adjustable bed base of claim 9, wherein the linear actuators are motorized.

12. The adjustable bed base of claim 11, wherein at least one of the strengtheners is generally U-shaped.

13. The adjustable bed base of claim 9, wherein each of the strengtheners is generally U-shaped.

14. The adjustable bed base of claim 9, wherein the head platform section is inclined when the front linear actuator is extended.

15. The adjustable bed base of claim 9, wherein the foot platform section is inclined when the rear linear actuator is extended.

16. An adjustable bed base comprising:

a stationary frame having opposed side rails, a head rail, and a foot rail;

a riser secured to the side rails of the stationary frame, a stationary seat platform section secured to the riser, a head platform section hinged to one side of the stationary seat platform section and a foot platform section hinged to the opposite side of the stationary seat platform section;

a front pusher assembly for moving the head platform section, the front pusher assembly comprising a front strengthener attached to the head platform section, the front pusher assembly further comprising a front linear actuator having a first end pivotally secured to a first cross rail and a second end pivotally secured to a mounting bracket secured to the front strengthener; and a rear pusher assembly for moving the foot platform section, the rear pusher assembly comprising a rear strengthener attached to the foot platform section, the rear pusher assembly further comprising a rear linear actuator having a first end pivotally secured to a second cross rail and a second end pivotally secured to a mounting bracket secured to the rear strengthener, wherein the head and foot platform sections are declined when the front and rear linear actuators are retracted.

17. The adjustable bed base of claim 16, further comprising legs secured to the stationary frame for supporting the stationary frame.

18. The adjustable bed base of claim 17, wherein at least one of the strengtheners is generally U-shaped.

19. The adjustable bed base of claim 16, wherein each of the strengtheners is generally U-shaped.

20. The adjustable bed base of claim 16, wherein the head platform section is inclined when the front linear actuator is extended.

* * * * *